United States Patent [19]

Del Principe et al.

[11] 4,422,639

[45] Dec. 27, 1983

[54] ELECTRONIC FOOTBALL GAME

[75] Inventors: Robert M. Del Principe, Hawthorne; Peter A. Oliphant, Van Nuys, both of Calif.

[73] Assignee: Mattel, Inc., Hawthorne, Calif.

[21] Appl. No.: 205,481

[22] Filed: Nov. 10, 1980

[51] Int. Cl.[3] ..... A63F 9/00

[52] U.S. Cl. ..... 273/94; 273/85 G

[58] Field of Search ..... 273/94, 85 G, 1 E, 16 C, 273/DIG. 28, 88

[56] References Cited

U.S. PATENT DOCUMENTS

| | | | |
|---|---|---|---|
| 3,724,852 | 4/1973 | Payne, Jr. | 273/94 R |
| 3,895,798 | 7/1975 | Collins | 273/94 R |
| 4,053,740 | 10/1977 | Rosenthal | 273/313 |
| 4,093,223 | 6/1978 | Wilke et al. | 273/94 R |
| 4,126,851 | 11/1978 | Okor | 273/DIG. 28 |
| 4,129,883 | 12/1978 | Stubben | 273/DIG. 28 |
| 4,177,462 | 12/1979 | Chung | 273/DIG. 28 |
| 4,249,735 | 2/1981 | Bromley | 273/94 |

FOREIGN PATENT DOCUMENTS 2807231 8/1978 Fed. Rep. of Germany... 273/DIG. 28

OTHER PUBLICATIONS

Rudolf F. Graf et al., "*Action Football Game*", 3/77.

*Primary Examiner*—Vance Y. Hum
*Assistant Examiner*—Leo P. Picard
*Attorney, Agent, or Firm*—Reagin & King

[57] ABSTRACT

An electronic football game having controls for two operators, the controls being divided in play calling controls and play actions controls. The game has a display upon which appear indications representing offensive and defensive players and the ball. Control circuitry operates in response to the controls to move certain players under operator control and other players under automatic control. Various of the players under automatic control may be preprogrammed to run selectable specified patterns or to attack specified targets.

12 Claims, 36 Drawing Figures

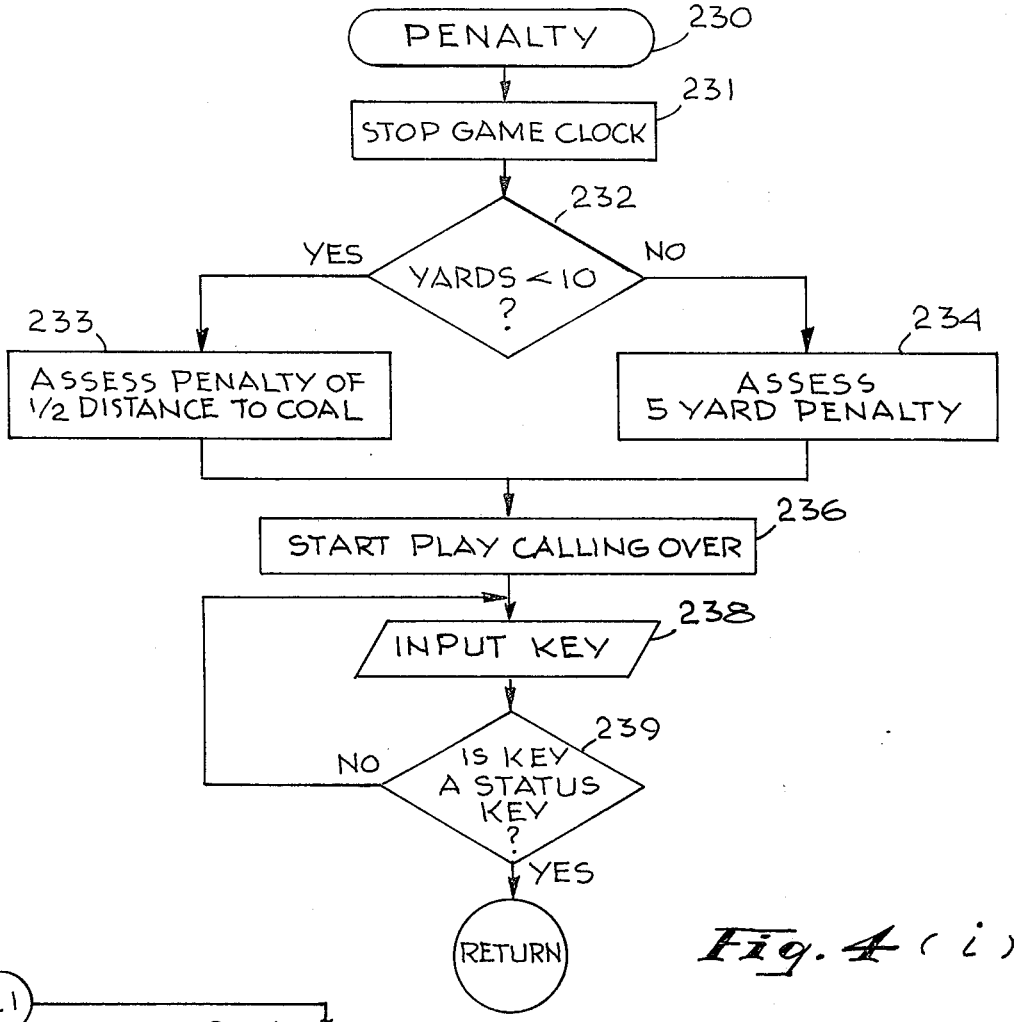
Fig. 4 (i)
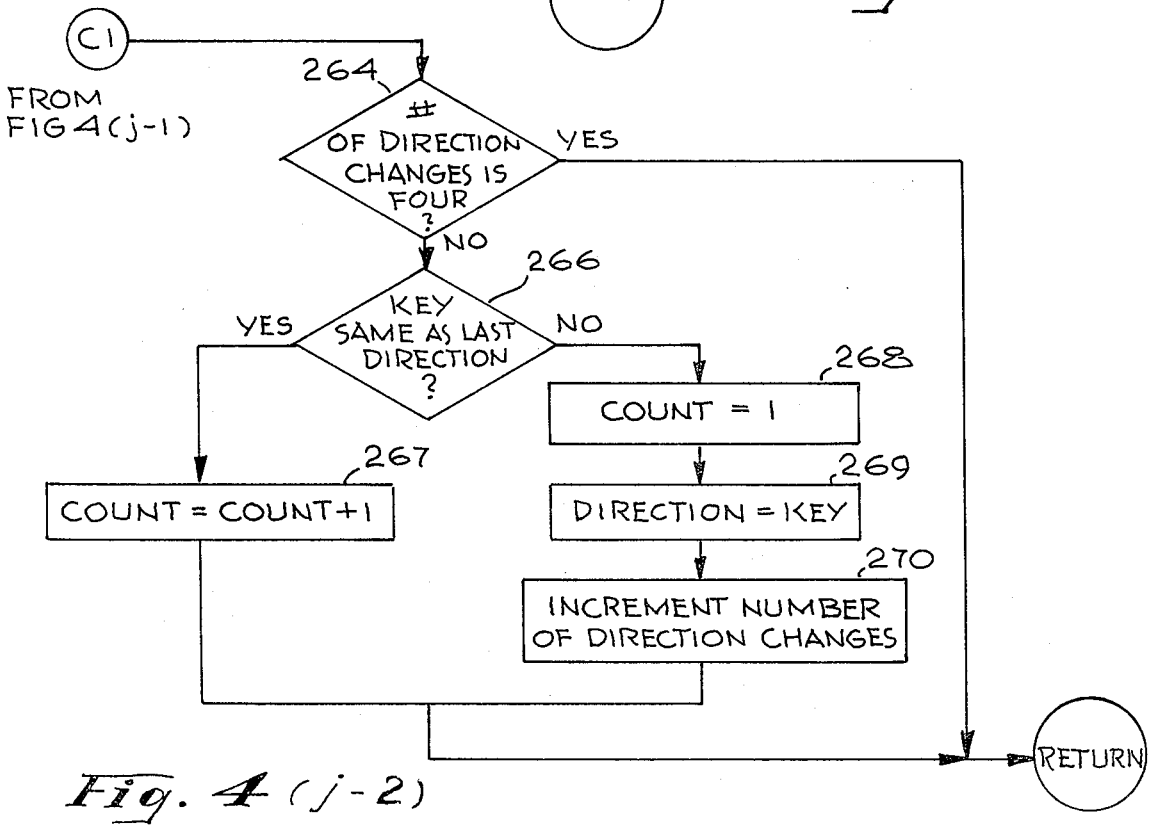
Fig. 4 (j-2)

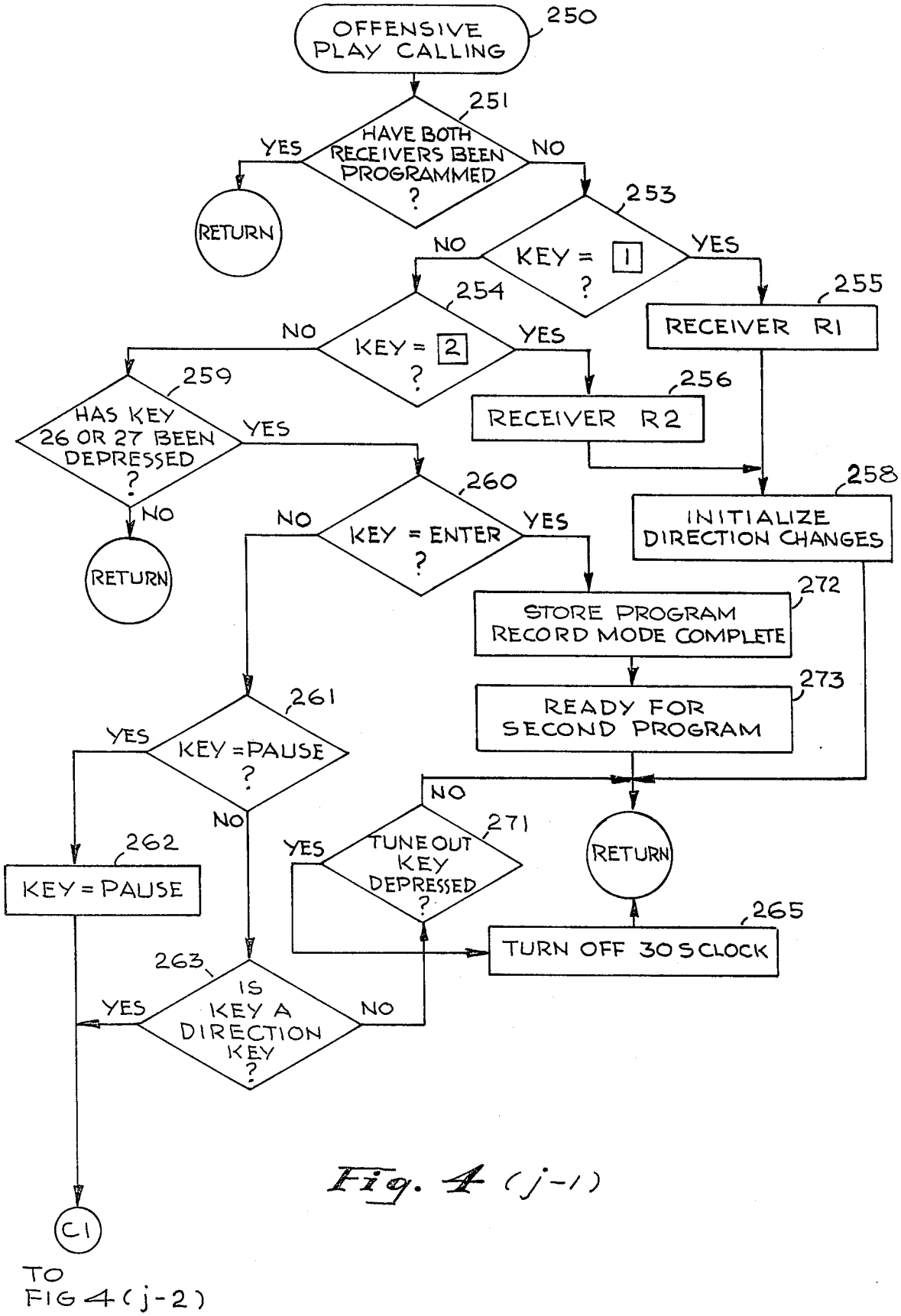
Fig. 4 (j-1)

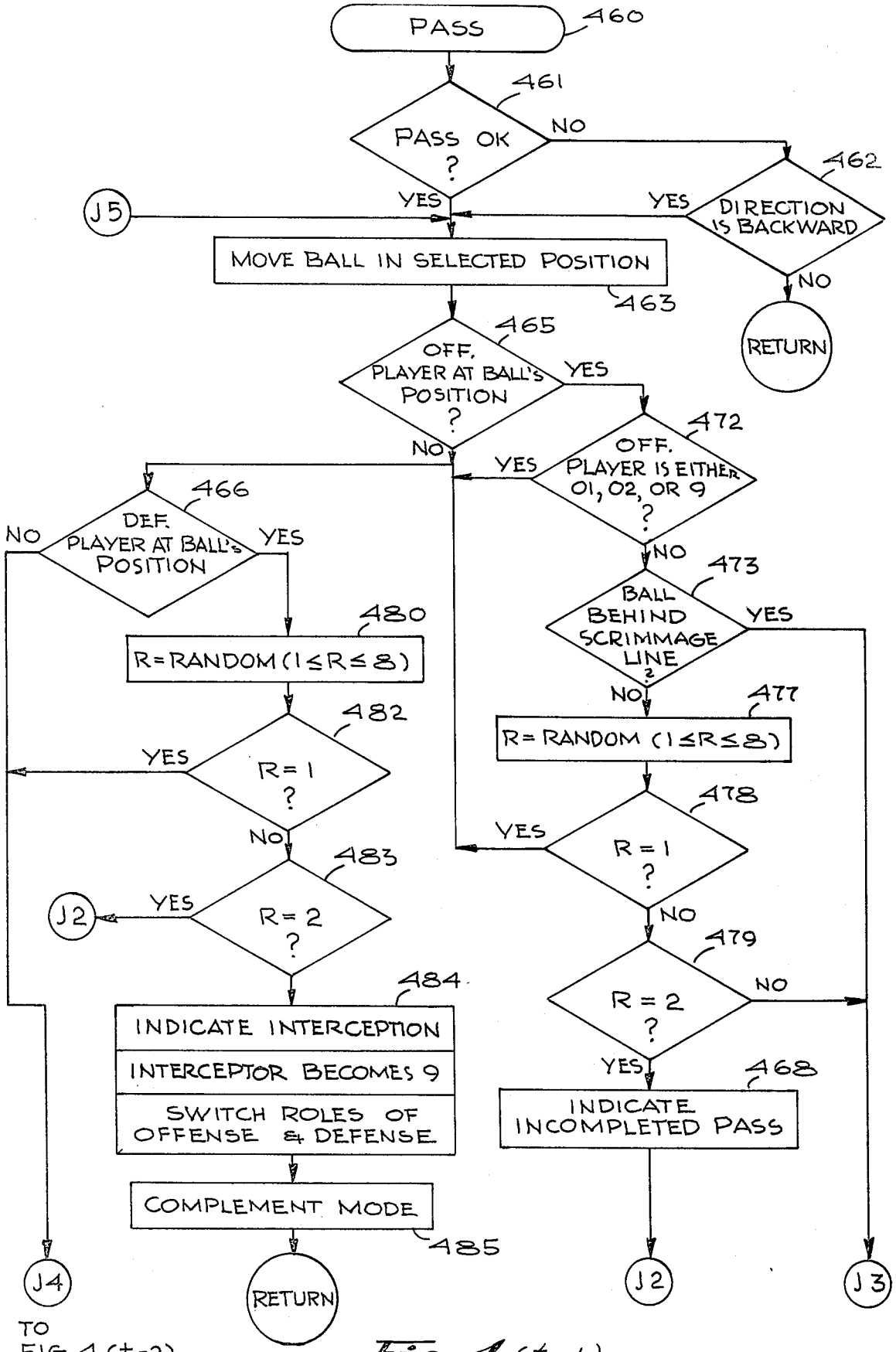
Fig. 4 (t-1)

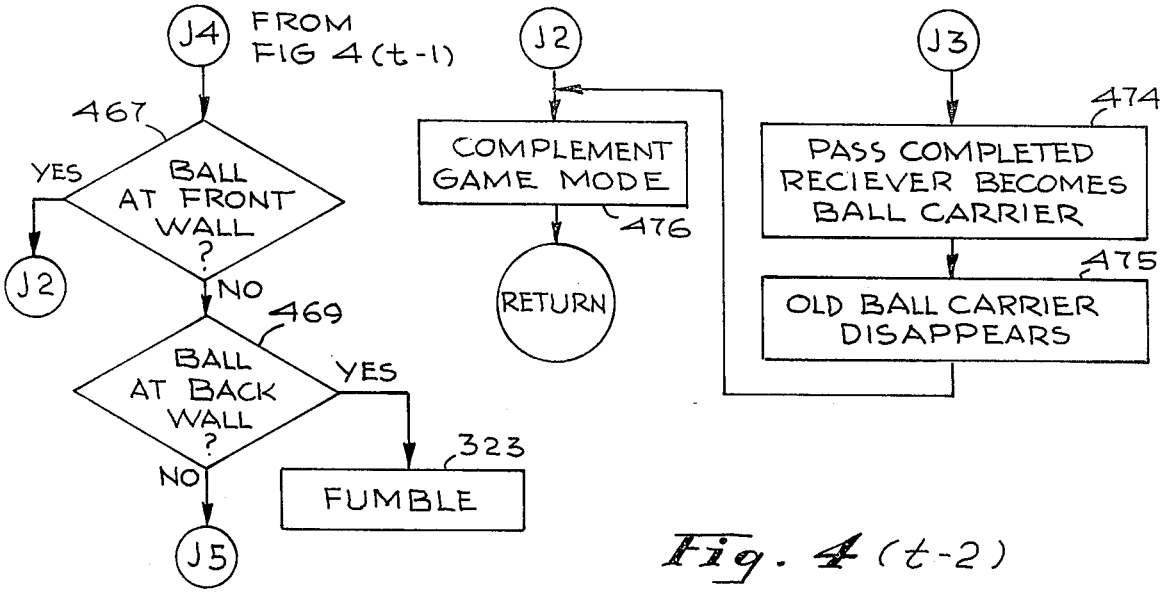
Fig. 4 (t-2)
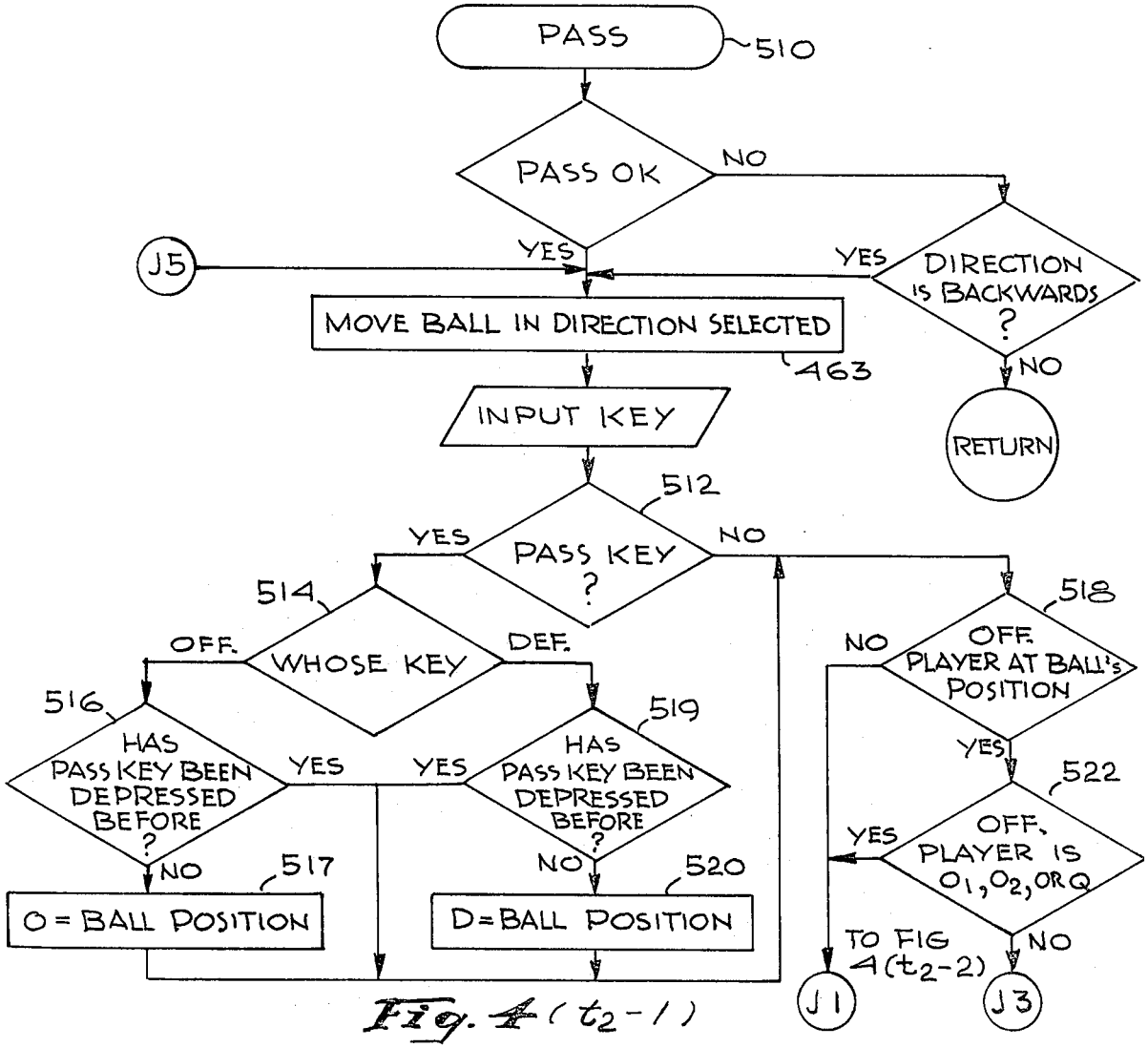
Fig. 4 (t2-1)

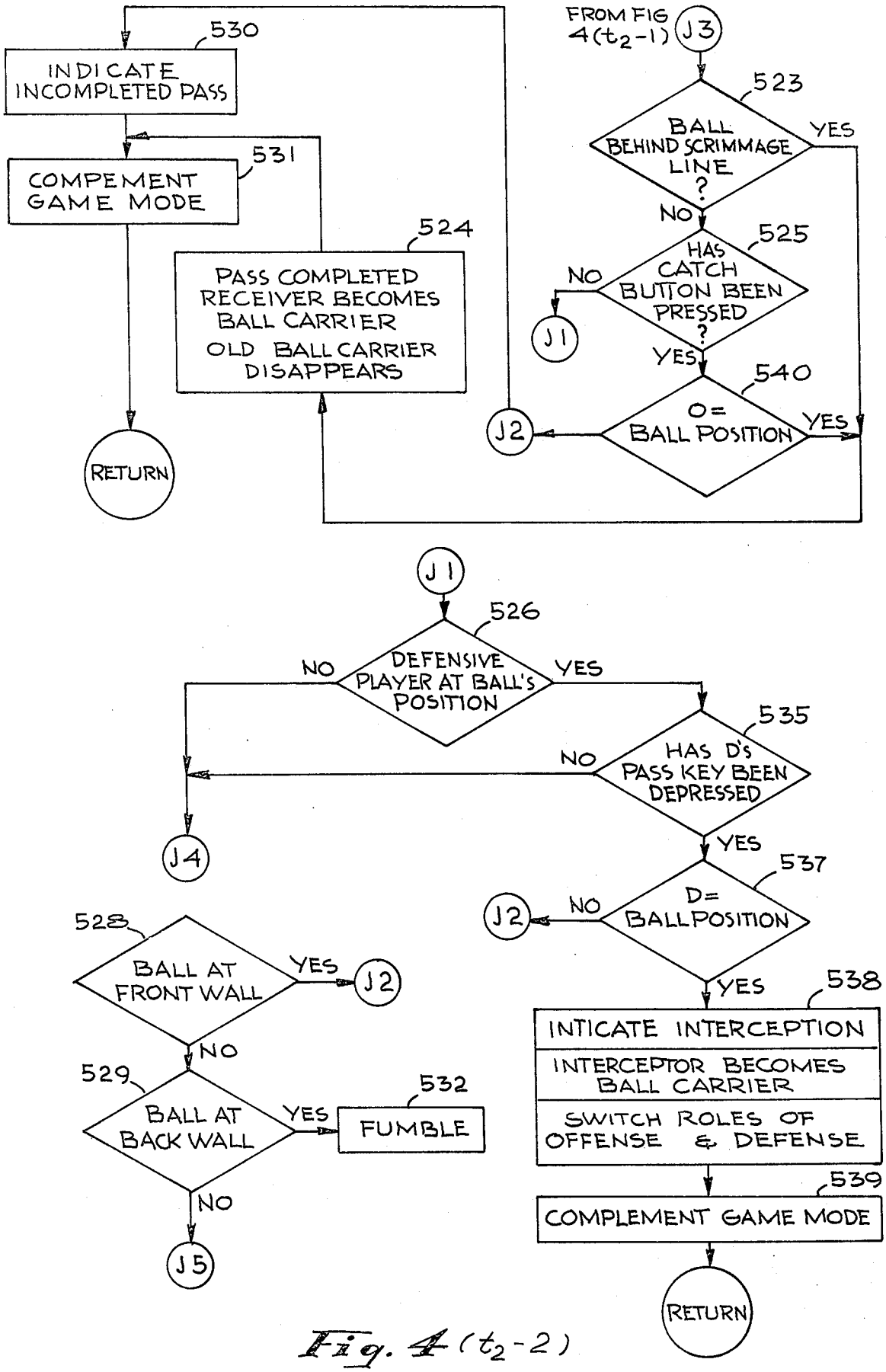
*Fig. 4* ($t_2$-2)

| ATTACKER \ ATTACKED | D | X | DI OR D2 | Q | RI OR R2 | OI OR O2 |
|---|---|---|---|---|---|---|
| D | | S | S | T ($^{15}/_{16}$) F ($^{1}/_{16}$) | S | S ($^{7}/_{8}$) $M_2$ ($^{1}/_{8}$) |
| X | S | | S | T | S | S |
| DI OR D2 | S | S | S | T | S | S ($^{7}/_{8}$) M ($^{1}/_{16}$) $M_2$ ($^{1}/_{16}$) |
| Q | T | T | T | | A | S |
| RI OR R2 | S ($^{7}/_{8}$) $M_2$ ($^{1}/_{8}$) | S ($^{7}/_{8}$) $M_2$ ($^{1}/_{8}$) | S ($^{7}/_{8}$) $M_1$ ($^{1}/_{8}$) | A | S | S |
| OI OR O2 | S | S | S ($^{7}/_{8}$) $M_1$ ($^{1}/_{8}$) | S | S | S |

WHERE: S = STAY (ATTACKER DOESN'T MOVE)
T = TACKLE
F = FUMBLE
$M_1$ = MOVE (ATTACKED MAN MOVES ALSO)
$M_2$ = MOVE (THROUGH ATTACKED MAN)
A = RI OR R2 IS ABSORBED (DISAPPEARS)
SHADED = ATTACKER AND ATTACKED ON SAME TEAM

Fig. 5.

ELECTRONIC FOOTBALL GAME

BACKGROUND OF THE INVENTION

This invention relates to games and, more particularly, to electronic games for simulating the play of athletic games.

People appear to have been involved in the playing of games since the beginning of recorded history. The almost universal interest in games seems to be due to the excitement engendered by competition and chance. Competitive games are probably more exciting, other factors being equal; but, they normally require that a number of persons be involved in each such game. Many competitive games require a large number of players, large fields, and a substantial amount of equipment.

Recently, various improvements in electronic circuitry have allowed the reduction in size and cost of data processing circuitry and have led to electronic circuits which simulate the play of various ones of the players in certain well known games. In these electronic games, a person moves an electronic player against electronic competitors thereby eliminating the necessity for some or all of the human players. Many of these electronic games are quite expensive. Often, the game must be connected to a television set to provide a display upon which the game may be presented and, consequently, cannot be moved from place to place.

Recently, a number of portable electronic games have been devised by which one or two persons may play a particular simulated sports game such as football, basketball, or baseball. These portable games have their own built-in displays and are much less expensive, in general, than those which must be connected to a television set. Their small size allows them to be carried about and used almost anywhere. However, these portable electronic games have relatively small displays, contain a limited amount of circuitry, and are usually powered by battery. Consequently, the portable electronic games heretofore devised have been relatively unsophisticated as contrasted to those which are associated with televison sets.

For example, electronic football games are known in which certain major actions of players may be simulated. Such games allow a player to direct a runner carrying a ball through a number of tacklers controlled by the control circuitry of the game or by another operator. Some such games allow a player to pass a football; other games provide a blocking feature. However, most such games only simulate an actual game of football in very crude outline.

It is, consequently, an object of this invention to provide a new and improved portable electronic football game.

It is another object of this invention to provide a new and improved electronic football game capable of play by two persons at a sophisticated level.

It is another object of this invention to provide an electronic football game operable at different levels of difficulty.

SUMMARY OF THE INVENTION

The foregoing and other objects of the invention are accomplished by a portable electronic football game which has an exterior housing mounting a display upon which indications representing the various players, the ball, and the results are presented. The housing also mounts input keys for controlling the operation of the game and contains electronic data processing circuitry for controlling the operation of the game. The input keys are, in general, divided between the two players so that one operator controls one team on the display while another operator controls the other team. The controls for each operator are divided into open controls used in controlling the players during play of game and hidden controls used to program the control circuitry so that it will operate certain players on both the offense and defense when play commences.

The preferred embodiment of the game features multiple offensive formations; programmable pass receivers; a programmable defensive back; forward, side, and back passes; time outs; a time clock for calling plays; out-of-bounds plays and time outs to stop the clock; penalties; on-side kicks; safeties; points after touchdown; and many other features of actual football games.

Other objects, features, and advantages of the invention will become apparent from the specification taken in conjunction with the drawings in which like elements are referred to by like reference designations throughout the several views.

BRIEF DESCRIPTION OF THE DRAWINGS

FIG. 5 is a table showing the interaction of the various players during the play of the game of the present invention.

DESCRIPTION OF THE PREFERRED EMBODIMENT

Figure 1:
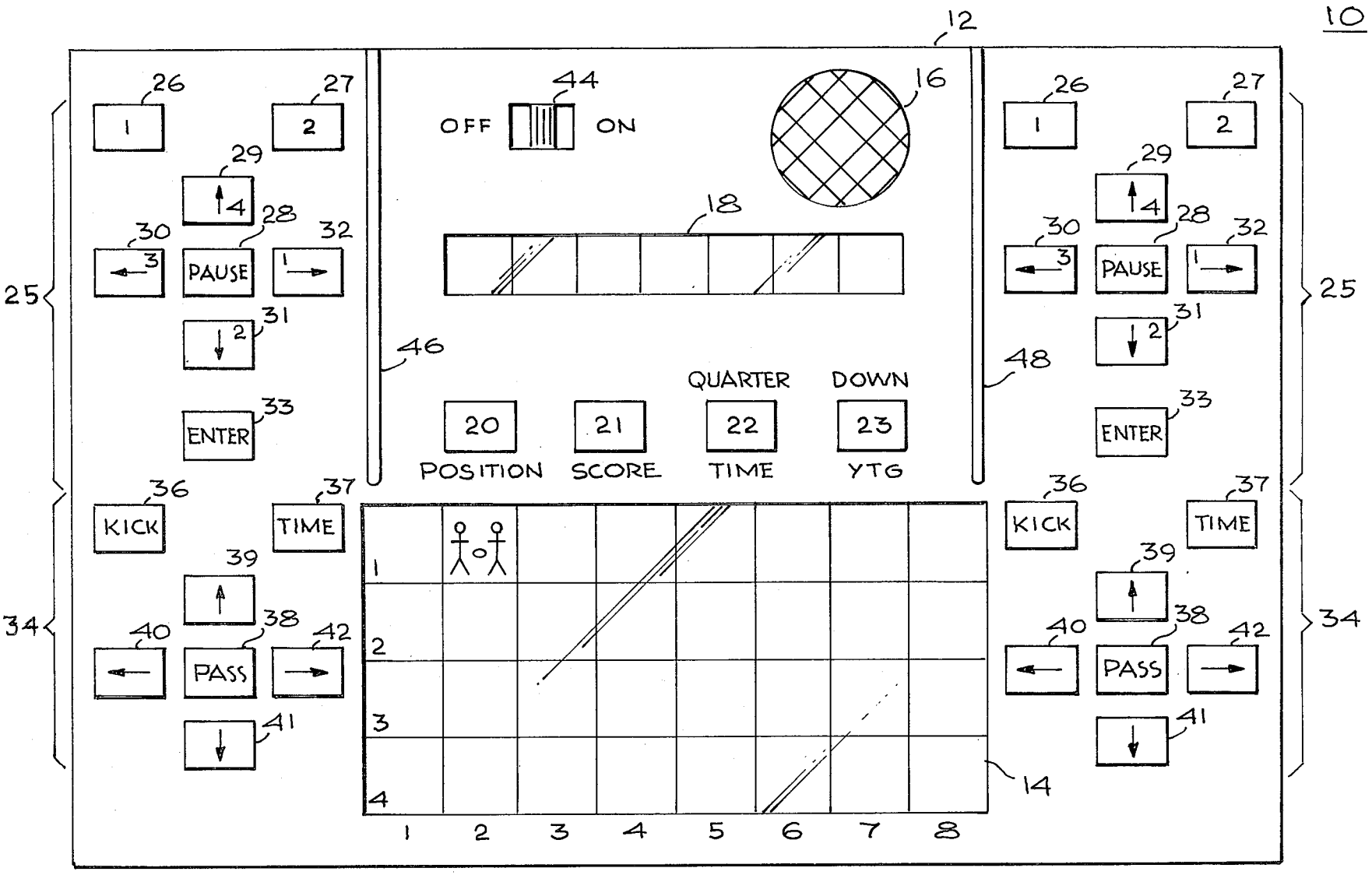
FIG. 1 is a top view of a console of a two operator football game constructed in accordance with the invention.

Referring now to FIG. 1, there is shown a top view of a console 10 utilized in playing the football game of this invention. The console 10 has a housing 12 which may be constructed of a material such as a moldable plastic, a number of which are well known in the art. The console 10 mounts a display 14 in its lower central portion and a speaker 16 in its upper central portion. Also mounted to the upper surface of the console 12 is a seven digit numeric display 18. Mounted below the numeric display 18 are a number of buttons, keys, or other forms of switches 20, 21, 22, and 23 which are utilized by the operators of the game for selecting information to be displayed by the numeric display 18.

Positioned to the left and to the right (as shown in FIG. 1) of the display 14 are buttons, keys, or other forms of switches generally designated as play-calling keys (consisting of individual keys 26–33) and play action keys 34 (consisting of individual keys 36–42).

In the preferred embodiment, the display 14 may be a multicolored fluorescent display which is controlled by the operation of control circuitry (not shown in FIG. 1) positioned within the housing 12 of the console 10. The display 14 is divided into four rows which are numbered for convenience from one through four starting at the top in FIG. 1 and eight columns which are numbered from one through eight starting at the left of FIG. 1. Each of these positions consists of two football players separated by a ball such as are shown in the position at row one, column two in FIG. 1. Each of the football players or the ball at any position may be individually illuminated by action of the control circuitry; and, in the preferred embodiment, the player on the left is green and represents the home team, the player on the right is yellow and represents the visitors, and the ball in the middle is red.

The method of selecting a particular player or ball at a position for illumination is well known to the prior art and will not be discussed in detail in this specification. However, for convenience of understanding, it is to be noted that each figure in a particular position is treated as though it were situated in a separate row. Consequently, for storage in the temporary memory of the control circuitry contained within the console 10, there are in effect twelve rows and eight columns of positions.

The numeric display 18 consists of seven individual seven segment digits of standard type which are well known in the art. In referring to these digits of the display 18 in the specification, the left-most digit in FIG. 1 will be referred to as digit number one and the right-most digit as digit number seven.

The speaker 16 is, in the preferred embodiment, a speaker of standard type utilized with microprocessor circuits. For example, a ceramic speaker 16 of a well known type may be utilized to provide sound outputs from microprocessor circuits which may be used to enhance the excitement of play of the electronic football game.

The game, once started, is divided into play calling and play action modes. They keys 20–23 are utilized for a number of different purposes in the play of the game mainly during the play calling mode. The main purpose of the keys 20–23 is to control the presentation of the game statistics in the numerical display 18. For example, during the period before kickoffs, the period before points after a touchdown, and during the play calling mode of the game, depression of the key 21 causes the home team's score to be displayed in the first two digits of the display 18, the visiting team's score to be displayed in the last two digits of display 18, and an indication of which team has possession of the ball to be given in digit three or five of display 18. In the preferred embodiment, the indication of possession appears in the digit of display 18 nearest the score of the team having possession.

During the same intervals of time, the depression of the key 22 causes the quarter of play (one through four) or an overtime indication to be displayed in the first digit of the display 18, the minutes remaining in the particular quarter to appear in the third and fourth digits, and the seconds left in the particular quarter to appear in the sixth and seventh digits.

Also during the same time periods, the depression of the key 23 causes the second digit of display 18 to display the down of the next play and the fifth and sixth digits of display 18 to indicate the yards to go for a first down.

Depression of the key 20 during these same intervals of time causes the field position of the ball to be shown on display 18. If the ball is at the home team's end of the field, the ball position is shown in the first two digits of display 18, while if the ball is in the visitor's end of the field the ball position is shown in the last two digits of display 18. If the ball is on the fifty yard line, fifty is displayed in both of the first two and the last two digits of display 18. During the running of plays on display 14, the field position of the ball appears on the display 18 and is constantly updated.

The keys 20–23 are also used after the completion of any action on the field of the display 18 to switch the game into the play calling mode of operation. This is accomplished by pressing any one of the keys 20–23. Depression of one of the keys 20–23 to switch the game to the play calling mode in most cases causes the display 18 to exhibit the number of time outs still available to each team and the time remaining during which plays may be called without the offensive team being penalized. The first digit of display 18 indicates the number of time outs remaining to the home team, the last digit indicates the number of time outs remaining to the visitor's team, and the fifth and sixth digits indicate the number of seconds remaining during which offensive plays may be called. If during the play calling mode time is not running, the word off is displayed by the three middle digits of display 18 rather than the time to go before penalty is to be called.

In the preferred embodiment, the offensive team is normally given only thirty seconds in which to call an offensive play before being penalized for delay of the game. The seconds used by the game may or may not be equivalent to seconds of real time; and, in the preferred embodiment, the seconds displayed by the various clocks are in fact substantially less than real seconds so that a game may be played in less than the time required for an actual football game. It should be noted that in any case in which one of the keys 20–23 is depressed, the information will appear only during the time that the button remains depressed in the preferred embodiment.

The play calling buttons 25 are used during the play calling mode for calling offensive and defensive plays. More specifically, the keys 26 and 27 are used by the operator of the team on offense to select a particular offensive receiver to be programmed to run a particular pattern. The keys 28–32 are used to program moves for the particular offensive receiver selected to be programmed. The keys 28–32 are also used to select a particular formation for play by the offense and to select a speed of operation for certain players shown on the display 18.

The enter key 33 is used after various of the play calling functions to cause the information to be entered in short term storage in the control circuitry of the electronic football game so that it may be used in executing the play action mode.

The keys 26 and 27 are used by the operator controlling the team on defense to indicate the particular offensive receiver assigned to the assignable defensive man as his target. The keys 29–32 are used on defense for selecting a row in which the assignable defensive man is stationed at the beginning of each play. The pause key 28 and the enter key 33 are ineffective in defensive play calling during the play calling mode of operation.

The play action keys 34 are used by the operator controlling the offensive team for directing the play of the ball carrier of the team in running and in passing. These keys are also used for initiating kicks and for calling time outs.

More particularly, keys 39–42 are used to direct the ball carrier (usually the quarterback) in running with the ball. When used with the pass key 38, the keys 39–42 designate the direction in which a pass is to travel. After a pass has been thrown and completed, the keys 39–42 are used on offense for controlling the movement of the player which has received the ball. The kick key 36 initiates a kickoff, a kick for a point after touchdown, a punt, and when used with the pass key 38 initiates an on-side kick.

The time key 37 is used, as will be explained hereinafter, to stop the running of the game and penalty clocks at times during which a time out may be called. A key 44 is used for switching the game on and off.

On defense, the keys 39–42 are used for directing the movement of a controllable defensive player. This movement (as with the movement of the controllable offensive player) proceeds at a rate of one space per depression of a key.

PLAY OF THE GAME

The game is energized when the switch 44 is switched from the off to the on position. When first energized, the display 14 is blank and the word "SPEED" appears in digit positions two through six of display 18. This word is a request for each operator to enter a difficulty factor which specifies how fast the offensive and defensive players controlled by the control circuitry will move and react while that player is on offense, the higher the factor, the faster the movement. The faster the players are moved by the control circuitry, especially the defensive players, the more difficult it is for the operator on offense; and, consequently, the more difficult it is to play the game. Each operator enters a different difficulty factor from one through four, and the offensive and defensive players controlled by the control circuitry will move at the rate specified by the operator controlling the offense. Thus, if one operator specifies a rate of one while the other specifies a rate of three, the players will move at the slower "one" rate while the first operator controls the offense and at the faster "three" rate when the second operator controls the offense.

Each operator enters a difficulty factor by depressing one of the keys 29–32 which carry numbers of one through four. Each of these numbers specifies the particular difficulty factor associated with the particular key. The operator may change the difficulty factor as many times as he desires until he finally presses the enter key 33. After both players have selected a difficulty level and each has depressed his enter key 33, the display 18 exhibits one number in the first left-most digit position indicating a difficulty factor for the operator controlling the home team, shows the word "SPEED" in the next five digits, and exhibits a number indicating the difficulty factor for the operator controlling the visitor's team in the right-most digit position.

After both players have depressed the enter key 33, the display 18 switches from showing the difficulty factors and displays an indication that time is out (the game clock is off) by showing the word off in digits three, four, and five of the display 18. The display 18 will also show a numeral three in the first and seventh positions to indicate that three time outs remain to each of the home and visitor teams at this point in the game.

Figure 3:
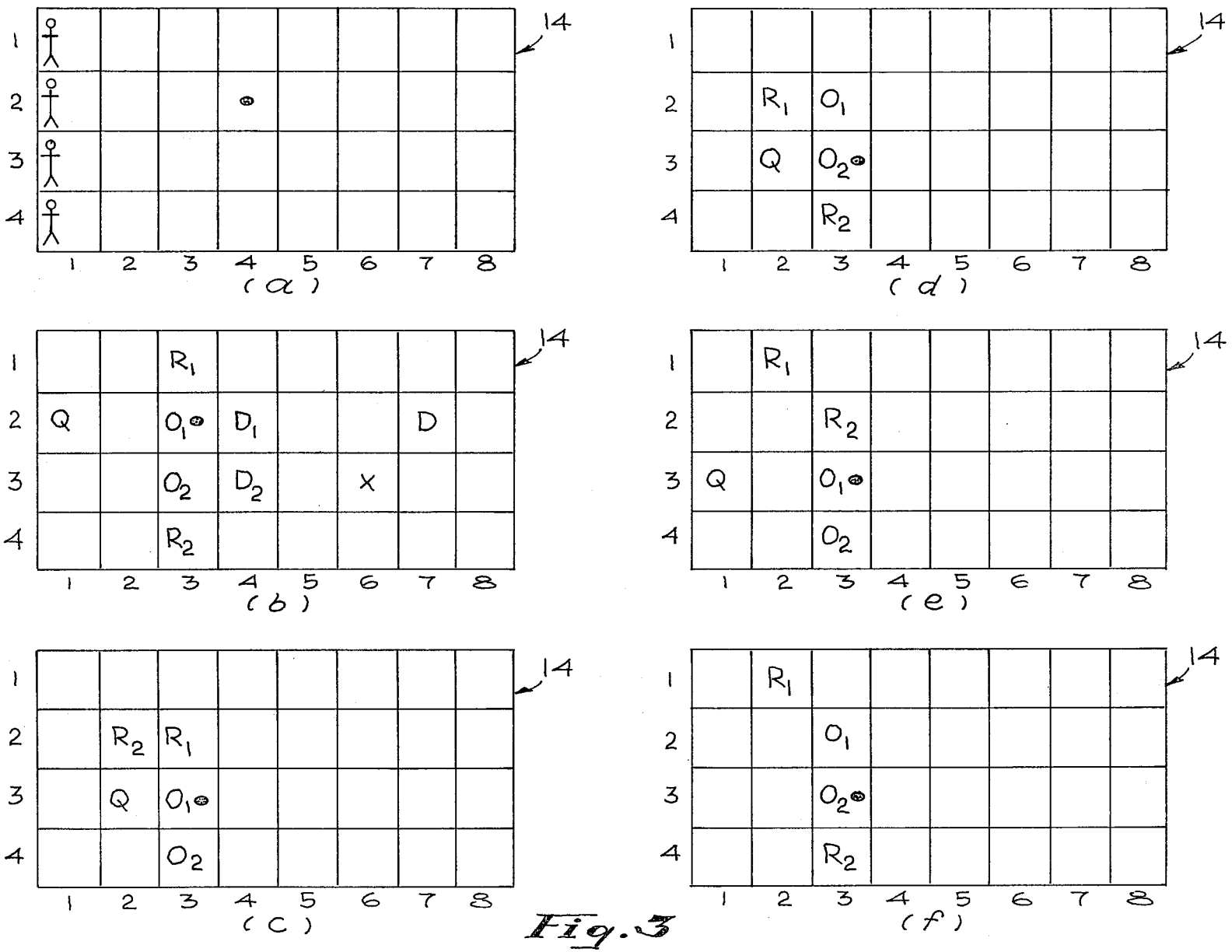
FIGS. 3(*a*)–3(*f*) are views of a display used in the invention.

Coincidentally, the display 14 will display the kickoff formation shown in FIG. 3(*a*). As will be noted, the kickoff formation shows a red ball illuminated at row two and column four and four home players lined up at column one of each of the rows. The kickoff formation is automatically shown on the display 18 of the electronic football game at the start of each half, at the start of an overtime period, after a successful field goal attempt, after any conversion attempt, and after any safety.

It should be noted that the formation shown in FIG. 3(*a*) is for a home team kickoff. Each formation which applies to the home team also applies to the visitor's team except that it is mirrored about an axis separating columns four and five. In the preferred embodiment, the home team kicks off for the first quarter of play; and the visitor's team kicks off for the third quarter of play. The team which kicks off for any overtime period is selected at random by the control circuitry of the game.

For the first four cases discussed above in which a kickoff takes place, the kickoff occurs with the ball on the thirty-five yard line of the kicking team; and the display 18 indicates this by displaying a thirty-five in the first two digits to the left for the home team or in the last two digits to the right for the visitor's team. In the case of a safety, the kickoff takes place from the twenty yard line of the kicking team; and this is indicated by the display 18.

The operator of the offense has two options on a kickoff. He may kick the ball normally or try an on-side kick. In the case of a normal kickoff, the operator merely depresses the kick key 36 in the offensive section. This first causes the display 18 and the display 14 both to go blank and the speaker 16 to sound a kickoff tune in the preferred embodiment. Then the display 14 redisplays the kickoff formation shown in FIG. 3(*a*) with the player in row two blinking to show that it is the kicker. Thereafter, all four players move one step at a time toward the ball each remaining in his row until all four players reach row four in which the ball is positioned. When the players reach row four, they vanish and the ball begins moving down the field to the right in row two (presuming the home team is on offense).

The ball continues until it crosses the right hand margin of the display 14 and then reappears in row two at column one. As the ball moves, the field position of the ball shown in the display 18 changes to constantly show the ball's position at each instant of time during the ball's movement. It should be noted that each column of the display 14 is considered to be one yard from the next column in either direction. The ball continues to move in its flight (disappearing out of the right hand side of the display 14 and reappearing at the left hand side) until it has traveled the entire distance of the kick. The ball travels on a kickoff a random number of yards down the field with the restrictions (in the preferred embodiment) that it must travel at least twenty-five yards and average forty-five yards per kickoff.

If the ball travels into the end zone, it is ruled dead and the play is over. In such a case, the display 14 goes blank; and the display 18 shows a twenty in digits six and seven indicating that the next play will start with the ball on the twenty yard line. Depressing any of the buttons 20–23 then causes the game to switch into the play calling mode.

If the ball stops short of the end zone during a kickoff, a kickoff return player appears at the point where the ball stops. As was explained above, the display 18 shows this field position. The kickoff return player is under control of the keys 39–42 operated by the nonkicking operator and may be moved down the field by depression of the keys 39–42. During a kickoff return play, four computer-controlled defensive players appear, one at a time, as the runner progresses down the field of the display 14 with the ball. Each of these players is programmed to stop the runner by being assigned to the ball.

By being assigned to the ball is meant that the player is controlled by the control circuitry of the game to make moves which place the player nearer the assigned position than the present position of the player. This is accomplished with defensive players assigned to the ball by first selecting a move for the defensive player at random. The move is then tested to determine whether it places the player in a position which is nearer to the ball than is the present position. If the position selected will place the player near the ball, the player makes the move if there is no other player in the way. If a player is in the way the move is aborted. When a defensive player moves through the same position as the ball carrier, the ball carrier is tackled.

As explained above, four defensive players appear on the display 14 as the runner returning the kickoff carries the ball down field. These players appear at random under control of the control circuitry of the game. The run of the player returning the ball stops if the runner is tackled, if the runner runs out of bounds, or if the runner crosses its goal into its goal zone and scores a touchdown. A tackle takes place when a defensive player attempts to move through the runner carrying the ball. The runner runs out of bounds when he attempts to move into the row above row one or the row below row four on the display 14. The runner scores a touchdown when he crosses the goal line as designated by the field position of the ball in display 18.

When a tackle occurs or a ball carrier moves out of bounds, play stops and the ball is positioned at the field position at which the particular action took place for the next play. Then, the play calling mode may be entered by pressing any of the keys 20–23. When a tackle is made at the end of a kick return, the display 14 shows the tackler and the runner blinking and the ball constantly lit. The remainder of the defensive players are also shown as constantly lit. When a runner runs out of bounds, the display 14 shows both the runner and the ball blinking while the defensive players remain constantly lit. If a runner scores a touchdown, the game switches to a point after touchdown conversion attempt formation which will be explained below.

It should be noted that the game clock (the clock timing the length of the game) runs on a kick return from the instant the ball reaches its final position on the kickoff until the runner is tackled, runs out of bounds, or scores a touchdown. The clock stops when any of these occur and only resumes counting game time at the start of the next play action mode.

An on-side kick is similar to a normal kickoff except that it is initiated by the operator first depressing the pass key 38 and then the kick key 36. Again, the displays 14 and 18 go blank (in the preferred embodiment) and the speaker 16 is caused to play a kickoff song. Thereafter, the normal kickoff sequence occurs with the players moving in sequence from column one into columns two, three, and four, then disappearing from the screen as the ball continues to the right (home team kicking). However, on an on-side kick the ball always stops on the fifty yard line.

At this point, the game clock starts, and the numerical display 18 indicates the fifty yard line field position. Four players, two offensive and two defensive, then appear on the screen, the two defensive players in the left hand corners of the display 14 and the two offensive players in the right hand corners of the display 14 when the visiting team is receiving. In the preferred embodiment, the control circuitry causes the ball on the fifty yard line to appear in column five which is closer to the right hand edge of the display 14 than to the left. Each of the offensive and defensive players is assigned the ball, and, since the fifty yard line is always one column closer to the receiving team than to the kicking team, the receiving players have a clear advantage in recovering the ball. The first player to enter the same position as the ball recovers the ball, and his team takes possession with a first down and ten yards to go on the fifty yard line. When a player recovers the ball, the display 14 lights that player continuously and causes the remainder of the players to blink. The ball is also continuously lit. The play calling mode is then entered by pressing any of the buttons 20–23.

The play calling mode of the game is entered by an operator depressing any of the keys 20–23 following any action between the teams which takes place on the field of the display 14. During the play calling mode, the operators set up defensive and offensive formations and plays. During this period, the operators may also check the statistics of the game using the keys 20–23 as explained above. It is also during the play calling mode that a penalty for delay of game 10 may occur.

When one of the keys 20–23 is depressed and the mode of play switches to the play calling mode, the play calling clock begins to run. The play calling clock occupies digits three and four of the display 18 during any period in which one of the buttons 20–23 is not depressed and in which a time out has not been called. The play calling clock begins running at thirty game seconds and runs down to zero game seconds. During this period, the offensive operator must program the offense and hike the ball or face a penalty for delay of game.

If the ball has not been hiked within the thirty second period, the displays 18 and 14 first go blank, a penalty sound is generated by the speaker 16, and the display 18 then shows the word "PEN" in the third, fourth, and fifth digits. Upon display of the word "PEN," the operator of the defense depresses any one of the buttons 20–23, and the penalty which will be assessed is shown by display 18 in the fifth and sixth digit positions. The penalty provided is five yards or half the distance to the goal if play is taking place inside of the ten yard line. The operator then depresses one of the keys 20–23 and the penalty is assessed. The field position of the offensive team changes by the penalty amount, and the game resumes in the play calling mode with the thirty second clock off as signified by the word "OFF" appearing in the three middle positions of the display 18.

The offensive operator may avoid a penalty by calling a time out. This is accomplished by depression of the time key 37 while the thirty second play calling clock is still decrementing toward zero. Depression of the time key 37 stops both the game clock and the thirty second play calling clock and charges a time out to the operator who presses it. A time out may also be called by the defensive operator by depressing his time key 37 should he feel it to be to his advantage. Only three time outs are allotted per team per half the game, and none are carried over to the next half of the game in the preferred embodiment. Two time outs are allotted for each team in the single overtime quarter should one occur. A time out is not charged if the time key 37 is accidentally pressed with the play calling clock off.

The thirty second play calling clock may or may not be running during the play calling mode. For example, the play calling clock does not run after a kickoff until the ball stops, when possession of the ball is changed between teams, when the quarterback runs out of bounds, when the quarter ends, when an incompleted pass has occurred during play, when a fumble has occurred during play, and during the time for a point after touchdown conversion attempt. Under any other conditions, the thirty second play calling clock begins decrementing once the play calling mode is entered. However, whenever the thirty second play calling clock is off, no time limit exists for calling play; and each operation may take as long as he likes to call a play. Time outs cannot be called in the preferred embodiment during the running of a play on the display 14.

There are, at the start of each play, five offensive players and four defensive players. The offensive players are referred to in this specification as a quarterback Q, a first receiver R1, a second receiver R2, a first offensive lineman 01, and a second offensive lineman 02. The defensive players are identified in the specification as a defensive safety D, a defensive back X, a first defensive lineman D1, and a second defensive lineman D2. In calling an offensive play, the operator first enters a formation and then programs two receivers. The offensive operator can choose from five possible formations in the preferred embodiment of the invention. These are referred to as a T formation, a pro set left formation, a pro set split formation, a slot left formation, and a slot left split formation. These formations are shown for the home team in FIGS. 3(*b*)–3(*f*) of the drawing. FIG. 3(*b*) shows the offensive lineup for the T formation. FIG. 3(*c*) shows the offensive lineup for the pro set left formation. FIG. 3(*d*) illustrates the positions for the offensive players in the pro set split formation. FIG. 3(*e*) illustrates the positions of the offensive players in the slot left formation. FIG. 3(*f*) illustrates the positions of the offensive players in the slot left split formation. In the preferred embodiment, all of the players on the screen of the display 14 will be lit continuously during the play calling mode so there is no way for the defensive operator to tell the difference between the formations shown in FIGS. 3(*c*) and 3(*d*), and in FIGS. 3(*e*) and 3(*f*). Consequently, the defensive operator must guess or wait until the ball is hiked to determine which players are playing which positions.

The offensive operator picks a formation by depressing one of the keys 28 through 32 causing one of the formations to appear on the display 14. By depressing the pause key 28, the operator selects the T formation. By depressing key 32, the operator selects the pro set left formation. By depressing key 31, the operator selects the slot left formation. By depressing key 30, the operator selects the pro set split formation. By depressing key 29, the operator selects the slot left split formation. The operator may change his selection until he is satisfied with the one provided on display 14. He then presses the enter key 33 which makes the choice of formation irreversible unless a time out is legally called and charged to one of the teams before the ball is hiked. If a time out it called, play calling starts over beginning with the selection of a formation.

Once a formation has been selected, the offensive operator programs the receivers R1 and R2. The receiver R1 is programmed by depressing the number one key 26. Keys 28–32 are then depressed in any order selected by the operator with the restriction that there may be only direction changes (i.e., four directions) programmed for any player including the pause condition as a direction. For example, receiver one may be programmed by first depressing the key 26, then depressing the key 32 four times, then depressing the key 31 two times, then depressing the key 28 five times, and finally depressing the key 30 two times. This will cause a receiver R1 positioned as shown in FIG. 3(*f*) to move in steps of one position traveling in row one from column two to column six, then to move to row three and column six, then pause for five counts, and finally to move to row three and column four. The programming of offensive receiver R1 is completed by depressing the enter key 33.

Player R1 may be reprogrammed if the enter key 33 has not been depressed by pressing the key 26 a second time followed by the appropriate keys 28–32 constituting the new pattern to be run and finally depressing the enter key 33. Even after the enter key 33 has been depressed, the program for the first receiver R1 or R2 to be programmed may be changed by simply redepressing the key and the particular receiver entering a new program. Once both receivers R1 and R2 have been programmed and entered, however, the programs for the receivers cannot be changed. The programming of the receiver R2 is identical to that for the receiver R1 except that the number two key 27 is depressed initially to indicate that the receiver R2 is being programmed.

Once the receivers have been programmed, they will run their patterns as play takes place and when they reach the end of their patterns will move at random about the final position. The receivers R1 and R2 will also move at random from their initial positions during play if they are not programmed to make any specific moves during play. This is accomplished by depressing a key 26 or 27 followed by the enter key 33.

In the preferred embodiment a programmed receiver R1 or R2 cannot step out of bounds or cross either of the end lines of the display 14. Such a programmed receiver attempts to complete its pattern before going into random motion about the last position in its pattern. If a receiver, however, cannot move in a given direction of its pattern due to an obstacle such as the out of bounds boundary, another player, or the end lines, the receiver waits for the obstacle to move and then continues its pattern. Hence, if a receiver is programmed to go out of bounds or if it arrives at an obstacle that does not move out of the way, it waits at that point until the end of the play.

Once both receivers R1 and R2 have been programmed, the control circuitry causes the speaker 16 to emit a sound to indicate to the defensive operator that the offense may hike the ball at any time.

Defensive play calling consists of only the two factors explained above. The defensive back X is moved to a particular starting row on display 14 and is assigned to one of the two receivers R1 or R2. As with the defensive lineman 01 and 02 assigned to the ball, the defensive back X attempts on each move to reduce the distance to its assigned receiver.

When the play calling mode is entered, the defense appears as is shown in FIG. 3(*b*). The defensive back X is positioned in a particular row by depressing the keys 29 and 31 to direct the defensive back X upward or downward from the initial position on the display 14. The position of the defensive back X may be changed until the ball is hiked by the offensive operator.

The assignment of the defensive back X to a particular one of the receivers R1 or R2 is accomplished by the defensive operator depressing his key 26 or 27 to indicate the particular receiver R1 or R2 selected. This may also be changed up until the time at which the ball is hiked by the offensive operator. If the defensive back X is not assigned to a player by depression of one of the keys 26 or 27, the control circuitry of the game automatically assigns it to the receiver R1.

This completes the description of the play calling mode of the game. It should be noted that from the standpoint of providing the most excitement, it is desirable that the play calling keys 25 be open to the view of only the operator using those keys. Consequently, a pair of screens 46 and 48 are shown positioned to isolate the keys 25 from the opposing operator. It should also be noted that in the preferred embodiment of the invention the keys 28-32 are functionally identical to the keys 38-42, and it would be possible to construct a game having only one set of such keys. However, because it is desirable to hide the play calling keys 25 from the opponent during the play calling mode yet to have the keys 34 in the open during the play action mode, two sets of keys have been utilized in the preferred embodiment.

The play action mode commences when the ball is hiked and ends coincidentally with the end of the play. The game clock always runs for the entire length of the play action mode unless the quarter ends during the running of the play.

When the play action mode is entered, each player on the field is given an assignment as follows:

| Player | Assignment |
|---|---|
| Q | None (operator controlled) |
| R1 | Preprogrammed |
| R2 | Preprogrammed |
| 01 | D1 |
| 02 | D2 |
| D | None (operator controlled) |
| X | R1 or R2 (preprogrammed) |
| D1 | Ball |
| D2 | Ball |

The above table means, for example, that the offensive lineman 01 is assigned to the defensive lineman D1 while the defensive lineman D1 is assigned to the ball. When the players interact by attempting to occupy the same position on the board or to move through a position occupied by another player, the result of the action is defined by the table shown in FIG. 5.

Thus, for example, where the player D moves to the same square as the quarterback Q, the quarterback Q is tackled fifteen-sixteenths of the time while a fumble occurs one-sixteenth of the time. If the defender D attempts to move through one of the receivers R1 or R2, however, the defender D stays in position rather than moving through (i.e., treats the receiver as an obstacle). By staying in position is meant that the player will stay at the last position in which a particular player constitutes an obstacle until that player constituting the obstacle moves out of the way. If the defender D attempts to move through one of the offensive lineman, it is held in position seven-eights of the time and moves through the lineman one-eighth of the time. The times at which the multiple possibilities occurs are selected on a random basis by the control circuitry of the game. The defensive back X tackles the quarterback Q when X attempts to move through the quarterback Q's position, stays in the same position when it encounters one of the receivers, and stays in the same position when it encounters one of the offensive linemen.

The defensive linemen, when they encounter the quarterback Q, tackle him, stay in position when they encounter the receivers, and stay in position seven-eighths of the time when they encounter offensive linemen. One-sixteenth of the time they move with the offensive lineman and another one-sixteenth of the time they move through the offensive linemen which they encounter.

The quarterback Q encountering the defensive safety D, the defensive back X, or one of the defensive linemen D1 or D2 is tackled. The quarterback Q encountering one of his own receivers R1 or R2 absorbs that receiver which then disappears from the display 14 for the remainder of that play. Moreover, the quarterback Q cannot run through one of his own defensive linemen and stays in the last prior position if he attempts to enter the same position. The receivers R1 and R2 encountering the defensive safety D stay in position seven-eighths of the time and move through the defender D one-eighth of the time. The receivers R1 and R2 treat the defensive back X and the defensive lineman D1 and D2 in the same manner. An offensive lineman 01 or 02 stays in position if it encounters the defensive safety D and stays if it encounters the defensive back X. It stays seven-eighths of the time if it encounters a defensive lineman D1 or D2 and moves with the defensive lineman one-eighth of the time. The other movements of the players on the field when encountering other players are clearly indicated by the table shown in FIG. 5.

Only the defensive safety D and the quarterback Q can move out of bounds in the preferred embodiment. If the defender D moves out of bounds, he is out for the remainder of the particular play. If the quarterback Q moves out of bounds, the play ends. In the preferred embodiment of the invention, the upper and lower boundaries of the display 14 are defined as out of bounds lines. The back wall of the display 14 behind the quarterback Q is considered to be impassable to any man and the front wall of the display 14 ahead of the quarterback Q can only be passed through by the quarterback Q or one of the receivers R1 or R2 when carrying the ball.

When the ball is hiked, the quarterback Q may run with the ball, may pass the ball to a receiver R1 or R2, or may kick the ball. A hike is accomplished by depressing the pass key 38 and the key 40 or 42 defining the direction from the ball to the quarterback Q at the time the ball is hiked (in the case of the home team, this is the key 40). The hike causes the ball to travel back to the quarterback Q at the same rate as is used for passing the ball. In the preferred embodiment of the invention, all of the players on the screen remain constantly lit until the reception of the hike by the quarterback Q. After the reception of the hike by the quarterback Q, the receivers R1 and R2 and the defensive safety D start blinking so that they may be identified on the field. This is the first point at which the operator of the defense is able to identify the receivers R1 and R2 in many cases.

The running of the quarterback Q and of a receiver R1 or R2 who has received a pass is accomplished by the use of the directional keys 39-42 controlled by the operator of the offense. By depressing any one of these buttons, the operator causes the ball carrier to move one position in a direction corresponding to the arrow on the particular key 39-42. If the key is pressed down three times, for example, the ball carrier will move three times in the particular direction. The running of the defensive safety D is controlled in an identical manner by the operator of the defense depressing the buttons 39–42 on his side of the console 10.

The only differences between the running of the quarterback Q or other ball carrier and the defensive safety D are the following. If the ball carrier goes out of bounds, the play ends; if the safety D goes out of bounds, the safety D is eliminated for the rest of the play but play continues. The quarterback Q may cross the front wall of the display 14 while the safety D cannot pass through the wall. The quarterback may absorb or run through the receivers R1 and R2 while the safety D is blocked by the receivers R1 and R2. It should be noted that if a receiver R1 or R2 receives a pass from the ball carrier, the control of the keys 39–42 on the offensive side switches to the new ball carrier, i.e., the receiver R1 or R2. This takes place each time the ball is successfully passed between players.

When the quarterback Q receives the ball on a hike he may pass the ball. This is accomplished by the operator of the offense depressing the pass key 38 and then one of the four directional buttons 39–42 to indicate the direction which the pass will take. It should be noted that the first depression of the pass key 38 after the hike switches the game into the pass mode, and the keys 39–42 may thereafter only be used to indicate the direction for a pass until the pass key 38 is again depressed to switch the game back to the run mode. The pass key 38 may be pressed as many times as desired to switch the game between run and pass modes.

Depressing the selected key 39–42 in the pass mode causes the ball to begin moving away from the quarterback in the direction indicated in one space steps. The keys 39–42 allow a forward pass, a back pass, or a lateral pass to be made. Back passes are allowed at any time that a ball carrier has possession of the ball, even after interceptions; forward and side passes are allowed only by the offensive team and only if the ball has not crossed the line of scrimmage. Once a pass is thrown, all keys cease functioning and all players on the field stop moving until the result of the pass has been determined.

When the pass button is depressed after the hike, the ball becomes invisible and remains invisible until it crosses the line of scrimmage or until the play ends. The ball will also become visible if a fumble occurs. This allows the quarterback to conceal the ball from the defense and run misdirection plays. Once the ball crosses the line of scrimmage, it remains visible for the rest of the play.

Once the ball has been thrown, the fate of the pass is based on the players encountered in its pass. The ball ignores all defensive men in the offensive backfield and the offensive linemen 01 and 02. The ball is caught by a receiver R1 or R2 one hundred percent of the time when these players are in the backfield. If no man is in a position reached by the ball, the ball continues on unless the next position is prohibited. As the ball reaches each point in its path of travel beyond the line of scrimmage in which a player other than offensive lineman 01 or 02 is positioned, that position is tested. Seventy percent of the time, the player catches the ball. Fifteen percent of the time, the player drops the ball for an incomplete pass ending the play. The other fifteen percent of the time, the ball continues on as though the man was not in the position. If both an offensive and a defensive player are at a position, the offensive player has the first try at the ball as explained above. If the ball passes through the offensive player, then the defensive player attempts to receive the ball based on the same probabilities (i.e., seventy percent, fifteen percent, fifteen percent) explained above. If the ball is neither received nor dropped by the defensive player, it passes through and continues on to the next position on the display 14.

In a second embodiment of the invention, a pass is caught by a receiver which coincides with the position of a passed ball B in flight if the pass key 38 of the offensive player is depressed at the instant of coincidence of the ball B and the receiver. If the pass key 38 is pressed before the ball B arrives, the ball B is dropped; if the key 38 is pressed after the ball B has passed the position, the pass is missed. In like manner, a pass may be intercepted by the defense by depression of the pass key 38 of the defensive player at the instant of coincidence with a defensive man.

A back pass which has not been caught or dropped and which encounters the back wall is considered to be a fumble and is treated as such. A forward pass which hits the front wall and a side pass which hits the side lines are ruled incomplete passes which stop the game clock and ends the play. Any incomplete pass stops the clock and ends the play.

If a pass is completed, the play continues in the run mode under the control of the offensive operator using the keys 39–42. If the ball has not yet passed the scrimmage line, it remains invisible even in the run mode. Furthermore the ball can still be passed even though it is invisible so long as it has not crossed the scrimmage line. If a pass is complete, the passer disappears and no longer has any effect on the play if the receiver is on offense. A pass completed to a man on defense is an interception, however, and the passer does not disappear.

An interception may be run back with the roles of the offense and defense switched. Thus, the operator previously controlling the defense uses his keys 39–42 for directing the player which intercepted the ball up the field toward his team's goal line. If an interception is caught in the end zone and the play ends in the end zone with the intercepting team in possession, it is considered to be a touchback and the ball is brought out of the twenty yard line for play to begin.

After an interception, the man intercepting the ball becomes the quarterback Q controlled by the keys 39–42 while the old quarterback Q becomes the new defensive safety D controlled by the keys 39–42 of the now defensive operator. The other new defensive players (of which only three remain on the screen) are assigned to the ball, and the former defensive players assume offensive roles. The men now on offense, however, except for the ball carrier retain the assignments they had before the interception.

Fumbles are caused in three ways: if a back pass is not caught and reaches the back wall, if a back pass is incomplete, or when the ball carrier is tackled. A fumble is recovered by any defensive or offensive player (other than the ball carrier) which is in or enters the point where the fumbled ball has come to rest. The ball carrier at the point where the fumble occurred must step out and back into that position in order to recover the ball. If using these rules, both an offensive and defensive player would recover the ball simultaneously, the offensive player wins the ball.

A fumble is signaled by the ball blinking on the display 14 with the play not yet over. Whenever the ball is fumbled, the point at which the ball comes to rest is the line of scrimmage for the next play, for, in the preferred embodiment, a fumbled ball cannot be moved by either side once recovered. If the offensive team recovers the ball, the next play continues as if the ball was advanced to the spot at which the fumble is recovered; that is, the downs are changed and the yards to go are changed when appropriate. If the defense recovers the ball, a change of possession takes place and the defensive team becomes the offensive team on the next play with the first down and ten yards to go. In either case, the thirty-second play calling clock does not run during the next play calling mode.

After the hike, the quarterback may kick the ball on any down in the preferred embodiment. Furthermore, on any down either a punt or a field goal may be attempted. Once the ball has been hiked and received by the quarterback Q, he may kick the ball providing it has not already been passed, that he has not stepped sideways, and that he has not passed the line of scrimmage. To initiate a punt, the kick key 36 is depressed while the game is in the run mode. A punt causes the ball to move as in a kickoff except that the ball starts at the point where the quarterback Q is at the time the kick key 36 is depressed. A punt travels for at least twenty-five yards, and punts average forty-five yards. If a punt reaches the end zone, the play ends and the ball is brought out to the twenty yard line. A kick which does not reach the end zone can be run back as in a kickoff.

A field goal attempt is caused by depression of the kick key 36 while the game is in the pass mode. If the game is not in the pass mode it may be initiated by first depressing the pass key 38 and then the kick key 36. A field goal attempt appears on the screen of display 18 like a punt with the ball traveling directly down the field. However, a field goal attempt which reaches the end zone scores three points for the kicking team and one which stops short of the end zone ends the play. This latter case is signaled by the ball stopping its progression down field and beginning to blink. After a successful field goal, the next step is a kickoff by the scoring team. If a field goal is not scored, the former defensive team takes over possession on the next play at the previous line of scrimmage.

A touchdown is scored by the ball carrier crossing into the end zone while carrying the ball. A touchdown is scored as six points. A touchdown initiates a point-after-touchdown conversion attempt. In such an attempt, the offensive players line up on the two yard line in the formation shown in FIG. 3(*b*) and the operator of the offensive team hikes the ball and depresses the kick button 36. No player moves on this play and the clocks do not run. The ball either scores a point (in ninety percent of the cases) or fails to score (in ten percent of the cases). If the point after attempt is unsuccessful, the ball remains blinking at the yard line where it stopped which will be indicated on display 18.

A safety occurs if the play ends with the ball in the quarterback Q's possesion in his own end zone (except after an interception). A safety scores two points for the defensive team. A team against which a safety is charged kicks off from its own twenty yard line. This kick is identical to a standard kickoff except that it takes place on the twenty rather than the thirty-five yard line and that an on-side kick is not allowed.

If a play ends other than by scoring, the display 14 shows different things depending on the circumstances. In the case of a tackle, every man except the ball carrier and the tackler is constantly lit. These two men blink in synchronization while the ball remains continuously lit in the preferred embodiment. If the play ends with a fumble, every player on the screen blinks in synchronization except for the player recovering the ball. That player and the ball are continuously lit. If the quarterback Q steps out of bounds to end a play, every other player on the screen remains continuously lit while the ball and the quarterback Q blink out of synchronization with one another. On an incompleted pass, the display 14 freezes as it was during play with those players blinking during play still blinking and those lit continuously remaining lit. All of these patterns of players are removed when one of the keys 20–23 is depressed to change the game from the play action mode to the play calling mode.

As has been explained above, various sounds are generated by the speaker 16 at various times during the progress of the game to add to the excitement. The following lists the events which occasion the sounds, the sounds used in the preferred embodiment, and the length of the sound in the preferred embodiment.

| Event | Sound | Duration |
|---|---|---|
| End of Play (not 4th down) | Whistle | Medium (½ sec) |
| End of Play (4 down turnover) | Whistle | Twice as long |
| First Down | Beep | Short (1/16 sec) |
| End of Quarter | Buzzer | Long (1 sec) |
| Score | Song #1 | Long (varied) |
| Kickoff | Song #2 | Long (varied) |
| Offensive Play Calling Done | Boop | Short |
| Penalty | Honk | Medium |

It is obvious that other sounds might be added as appropriate to additionally enhance the excitement of the game.

If the score is tied after four quarters in the preferred embodiment of the game, a fifth quarter is played. The team on offense is determined randomly, and a kickoff is set up. This overtime quarter is played under "sudden death" rules in that the first team to score wins the game. If no score occurs during the fifth quarter after fifteen simulated minutes of play, then the game ends in a tie. Two time outs are allotted during overtime in the preferred embodiment.

Figure 2A:
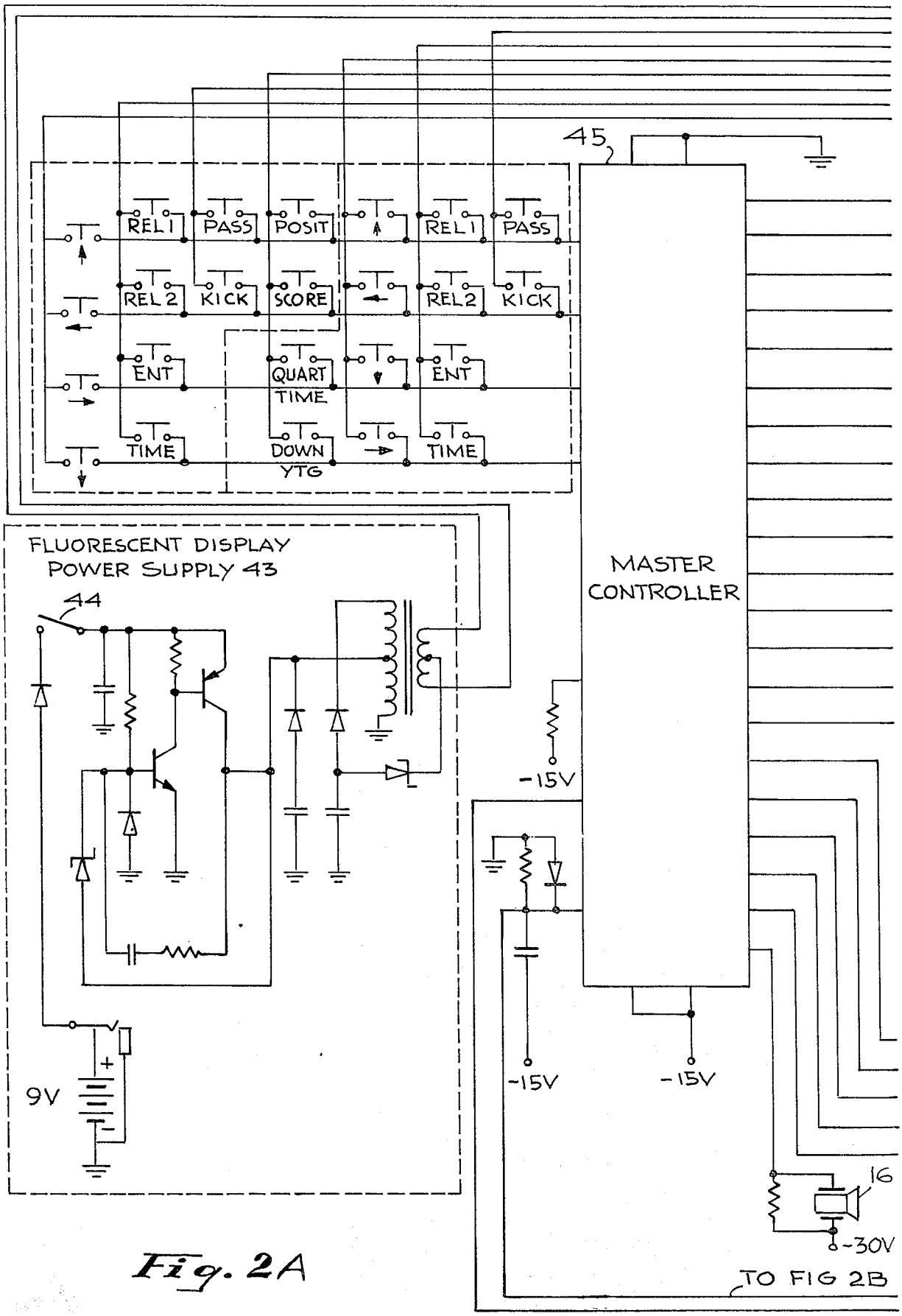
FIG. 2 is a block/schematic diagram of a circuit arrangement for the invention.
Figure 2B:
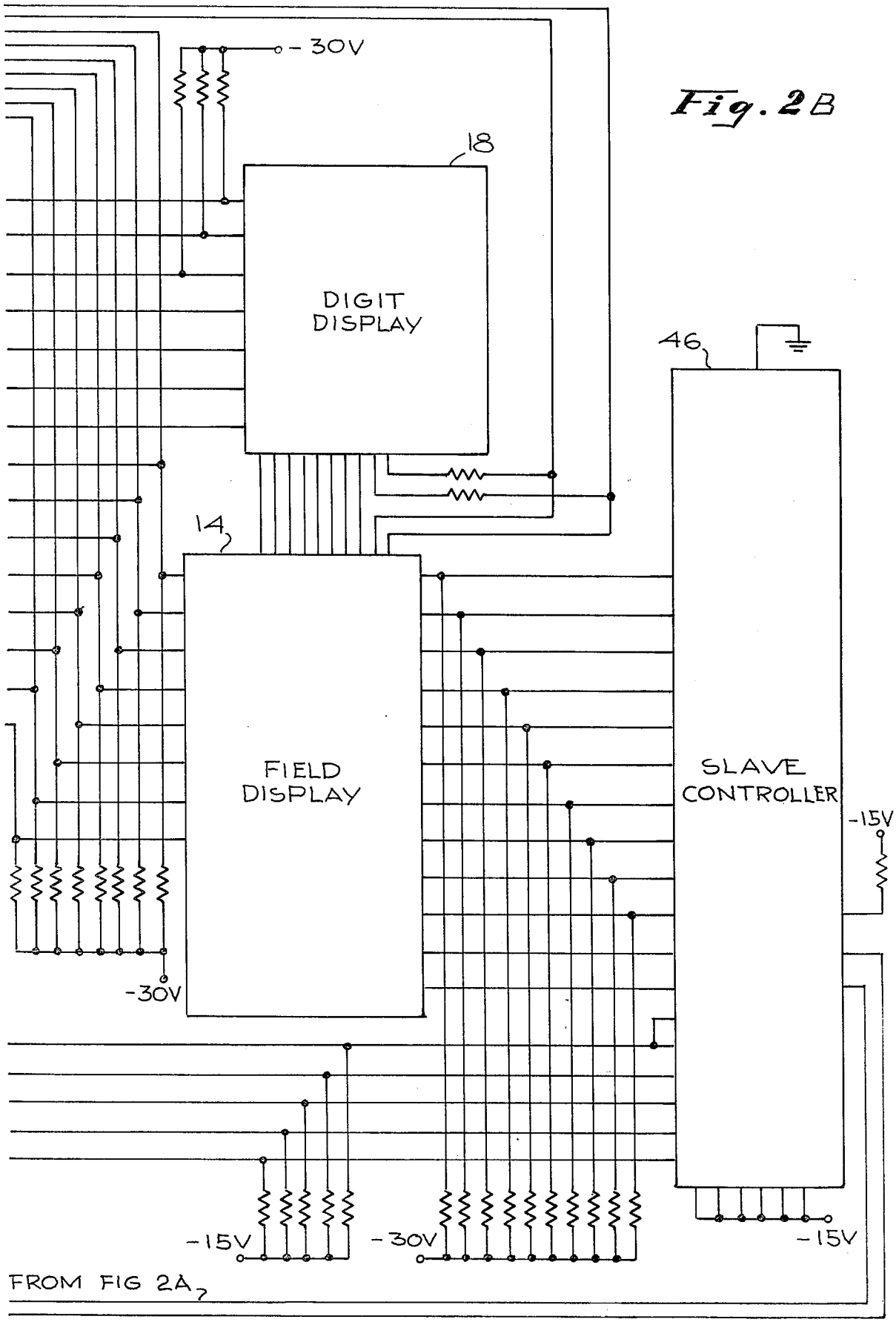

FIG. 2 illustrates a partially schematic/partially block diagram of circuitry for implementing the game of this invention. The arrangement includes a circuit 43 used for applying power to the game when the switch 44 shown in FIG. 1 is turned on. It should be noted that the circuit 43 includes a nine-volt power source such as a transistor battery and has a jack through which rectified line current may be supplied to power the circuit. Power is supplied by a transformer in circuit 43 to both the display 14 and the display 18 shown in block form in FIG. 2.

The control circuitry of the game is included in two blocks designated as master controller 45 and slave controller 46. As will be understood by those skilled in the art, the two controllers 45 and 46 may be implemented in any of a number of ways. However, as with many prior art electronic game circuits, the preferred embodiment of the invention utilizes two integrated circuit microprocessors which are, in effect, miniature digital electronic computers. Such integrated circuit microprocessors are well known and include all of the input, output, memory, logic and control circuitry of a special purpose digital computer in miniature form. In general, such circuits have both random access memory (RAM memory) and read only memory (ROM memory). The ROM memory has connections formed by masking operations during the contruction of the basic circuitry of the controllers 45 and 46 which provide a set of completely wired circuits which include the program of controlling the operation of each of the microprocessors. Such arrangements are often described as dedicated memory circuits. The RAM memory of the microprocessors is utilized for storage of the various bits of information during the operation of the circuitry.

Although many electronic games known to the prior art utilize circuitry on a single chip, the present invention utilizes two essentially similar controllers 45 and 46 which are individually masked in such a way as to provide a substantial increase in the memory capability of the game over those of the prior art so that more sophisticated operation may be accomplished. Various controller circuits (each usually produced on a single chip of the material) are offered by a number of manufacturers and are well known to the prior art. A preferred embodiment of the present invention uses two A78 microcontrollers manufactured by Rockwell Industries. The circuit of the A78 controller is better described in the user's manual therefor published by Rockwell.

As may be seen in FIG. 2, closure of the various input keys referred to in FIG. 1 provide input signals at the various input terminals of the master controller 45 and the field display 14. Various cross connections are made between the field display 14 and the digit display 18, between the master controller 45 and the slave controller 46, between the master controller 45 and the digit display 18, and between the slave controller 46 and the field display 14. Power to operate the various circuits and the timing pulses, and other conventional items of circuitry are provided as shown in FIG. 2. The speaker 16 is connected as an output of master controller 45.

Figure 4A:
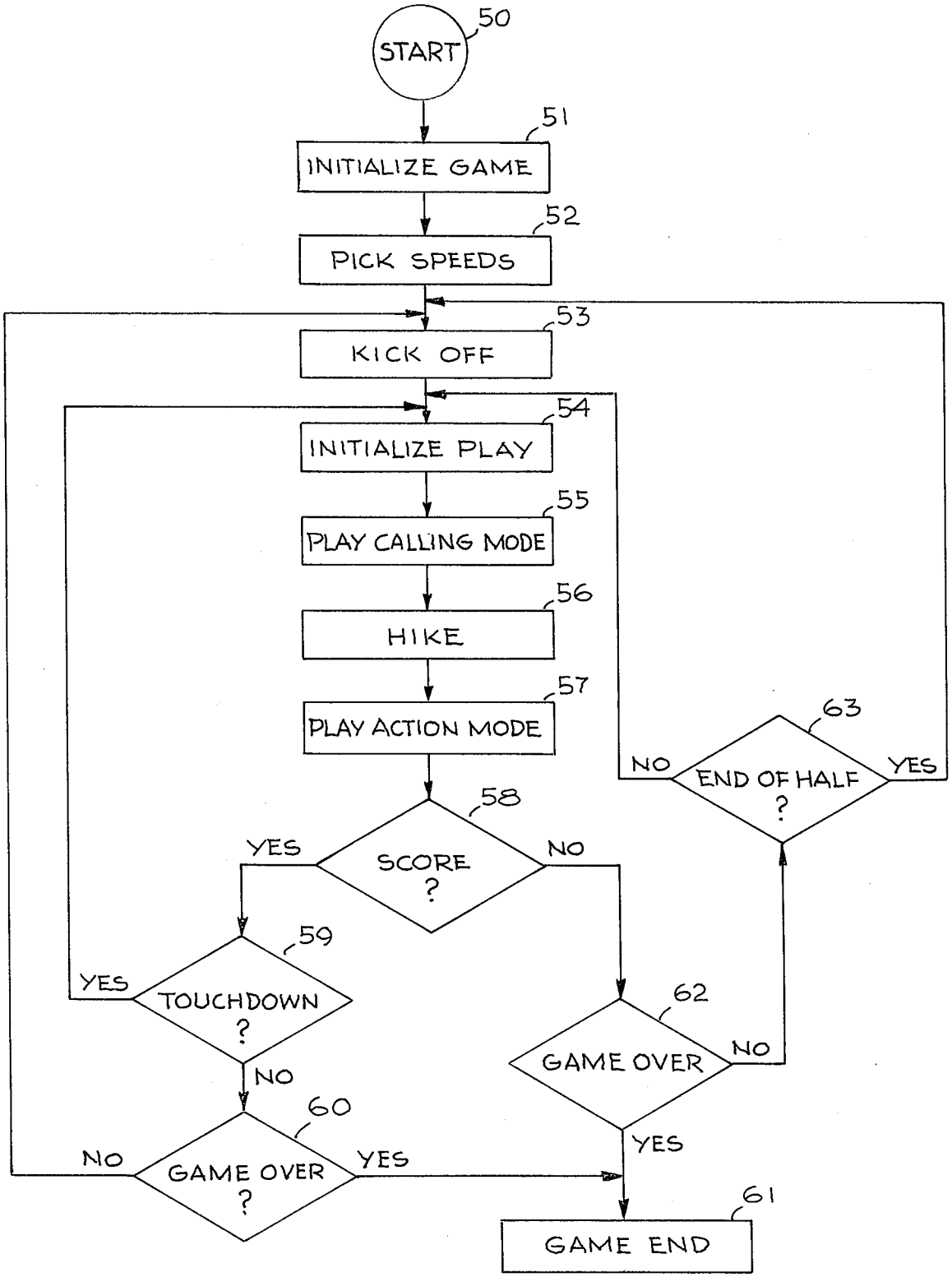
FIGS. 4(*a*)–4(*v*) are flow charts illustrating the operation of the invention.
Figure 4:
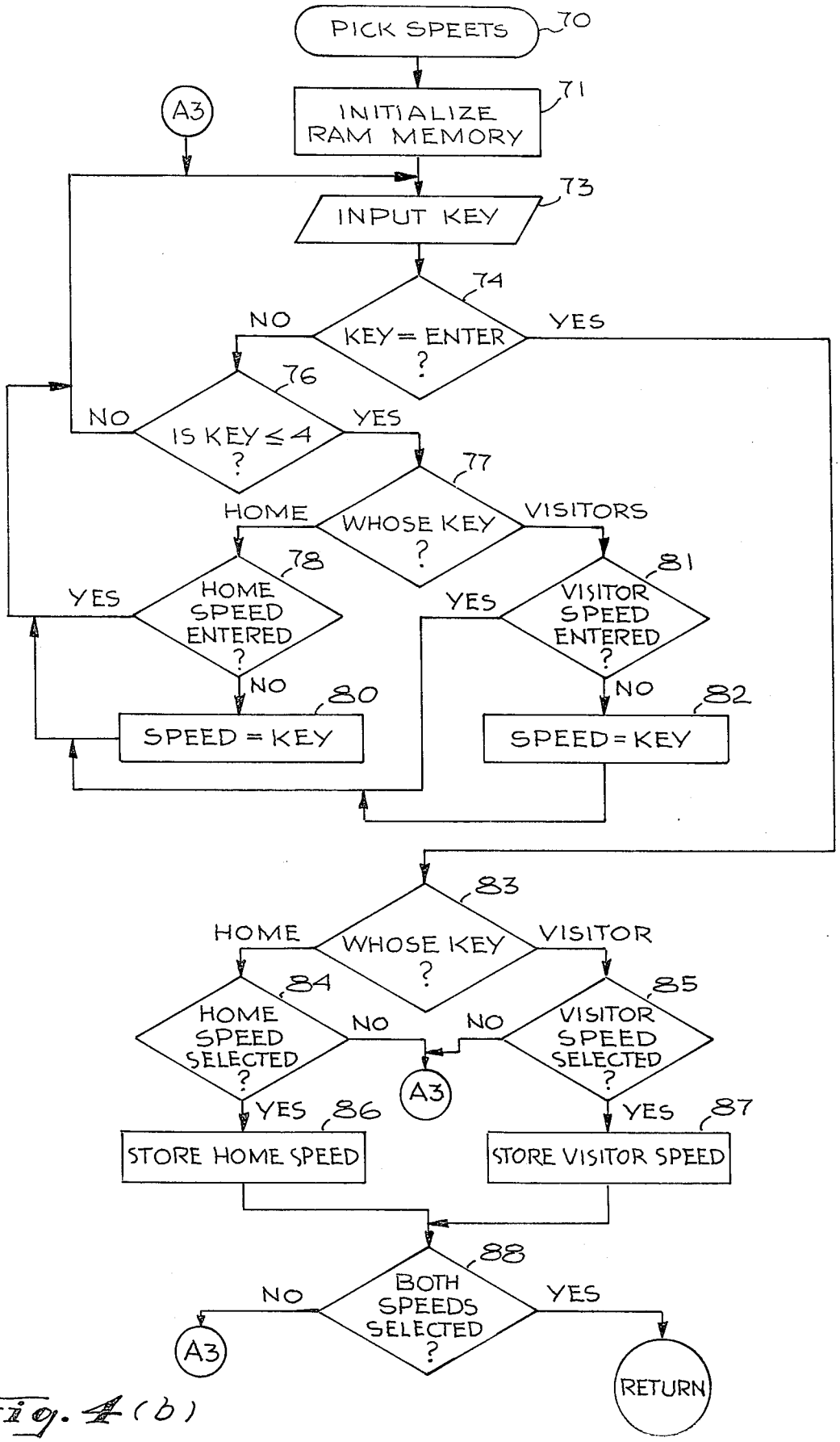
Figure 4:
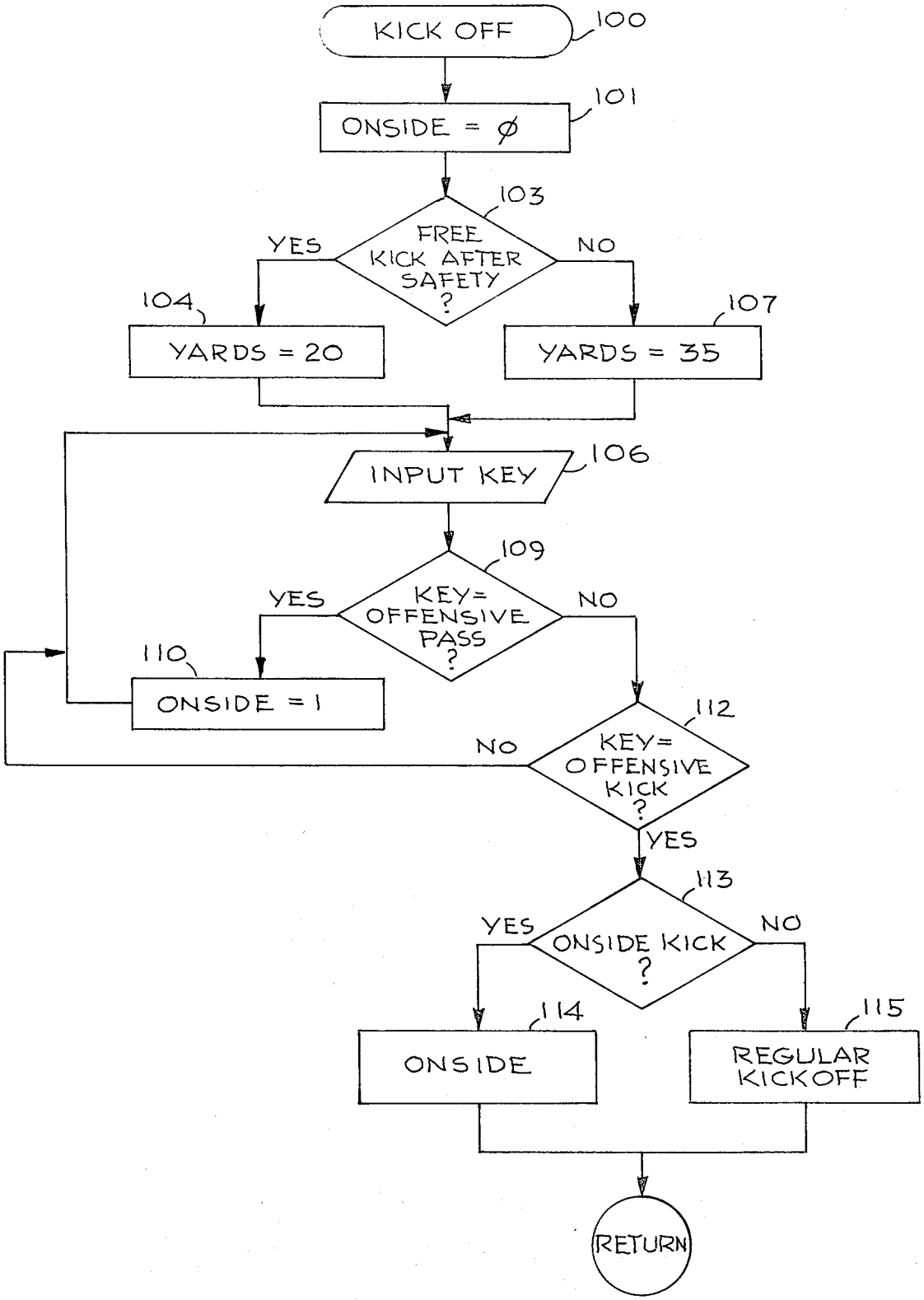
Figure 4D:
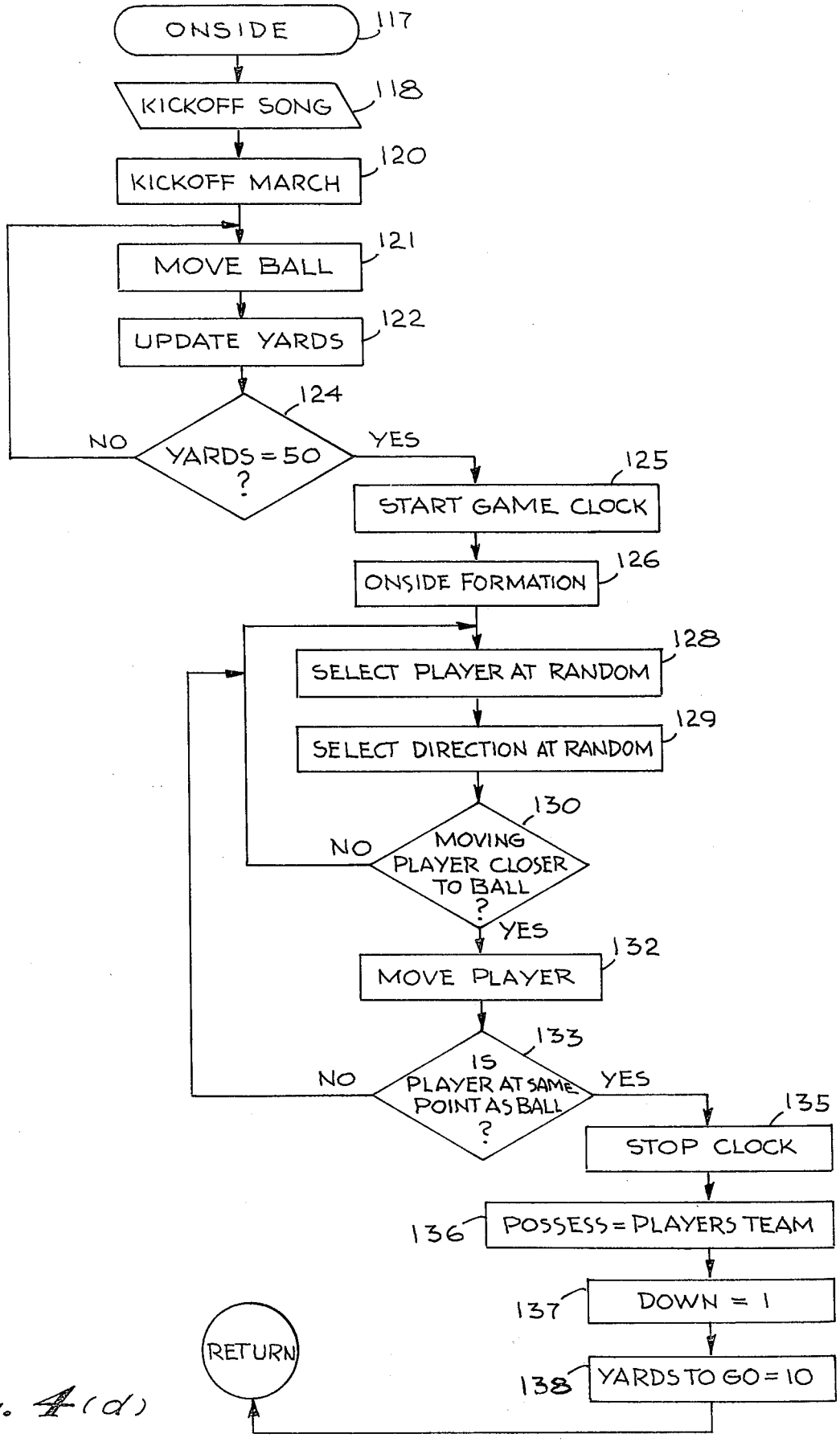
Figure 4E:
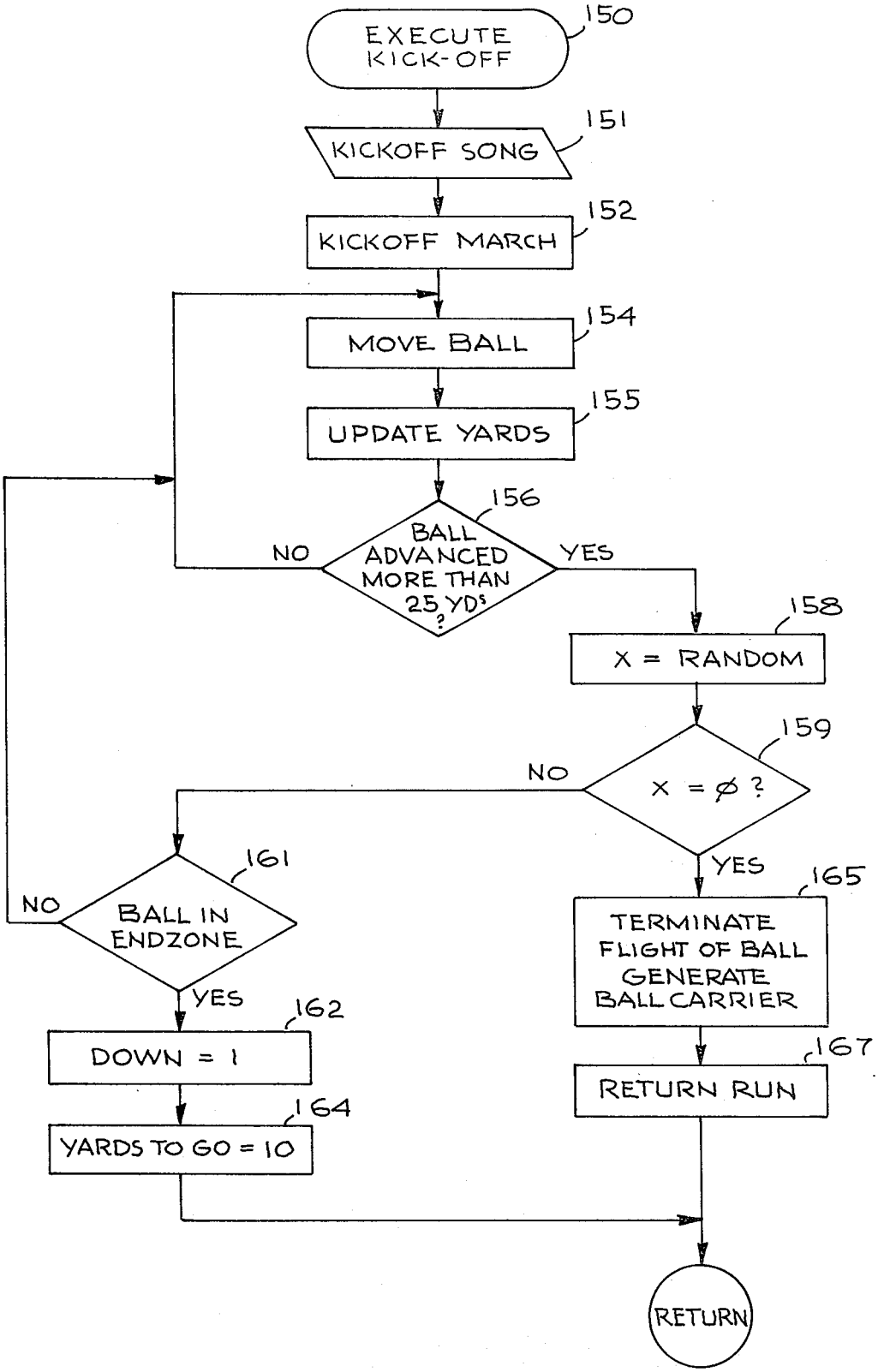
Figure 4:
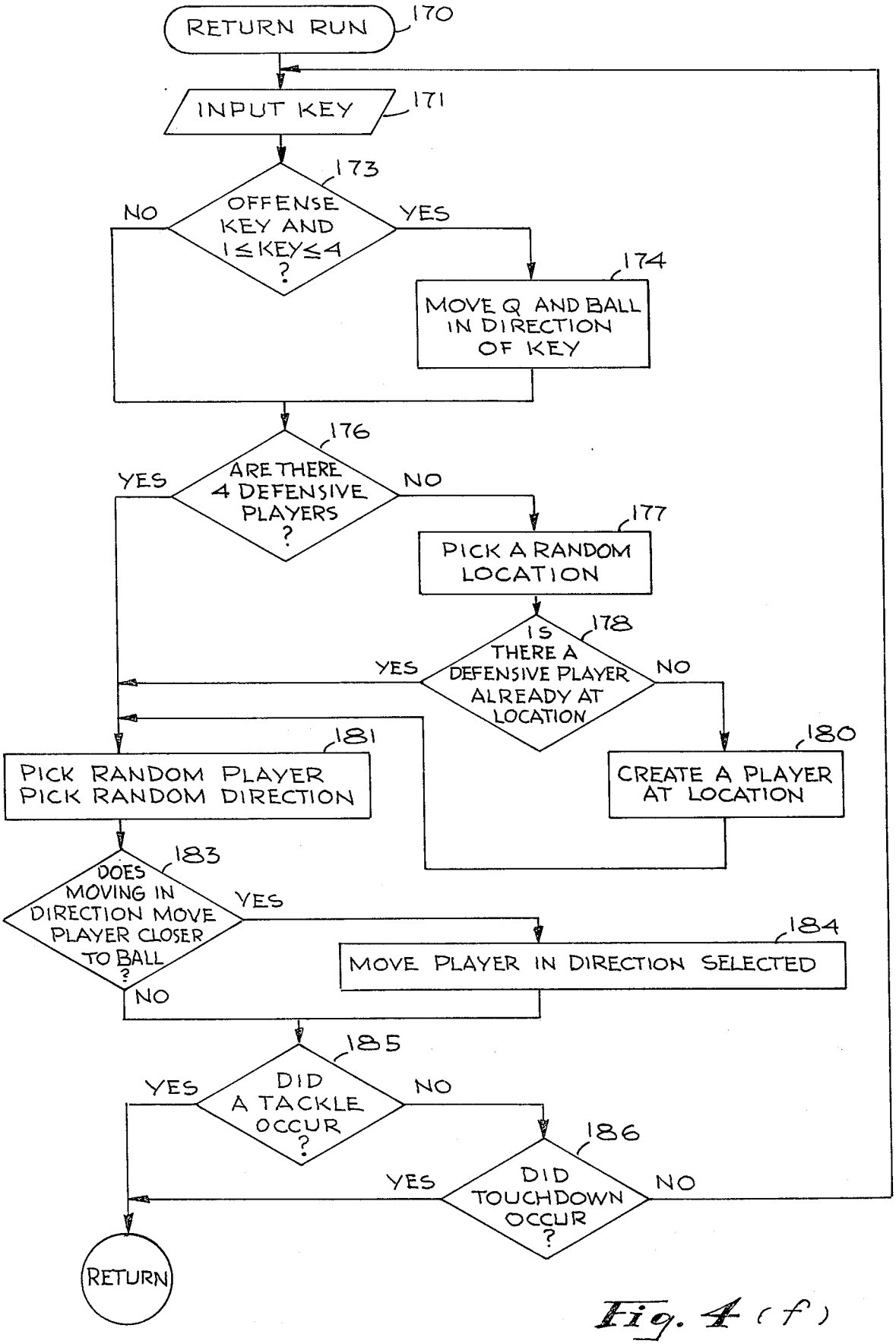
Figure 4G:
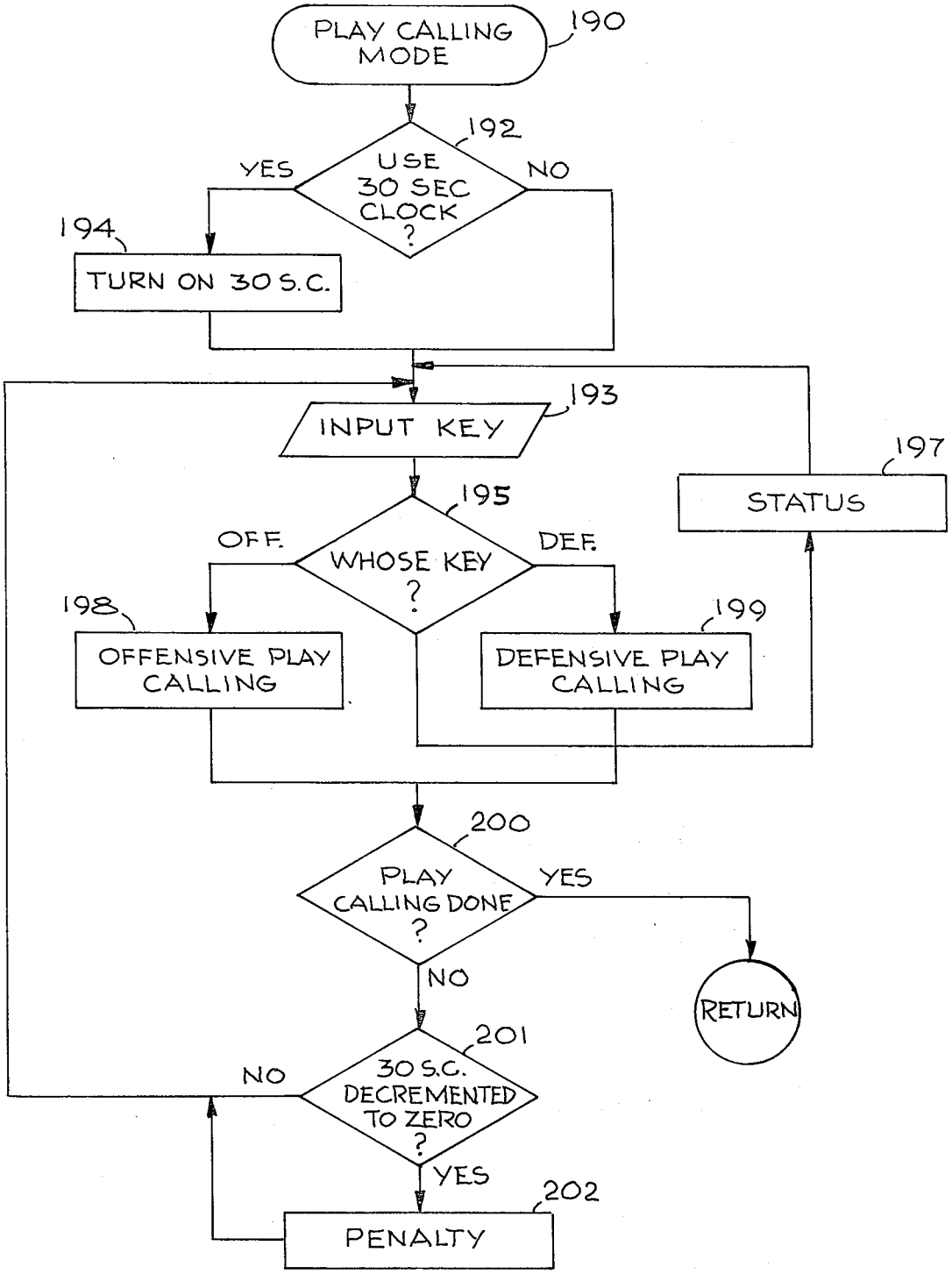
Figure 4H:
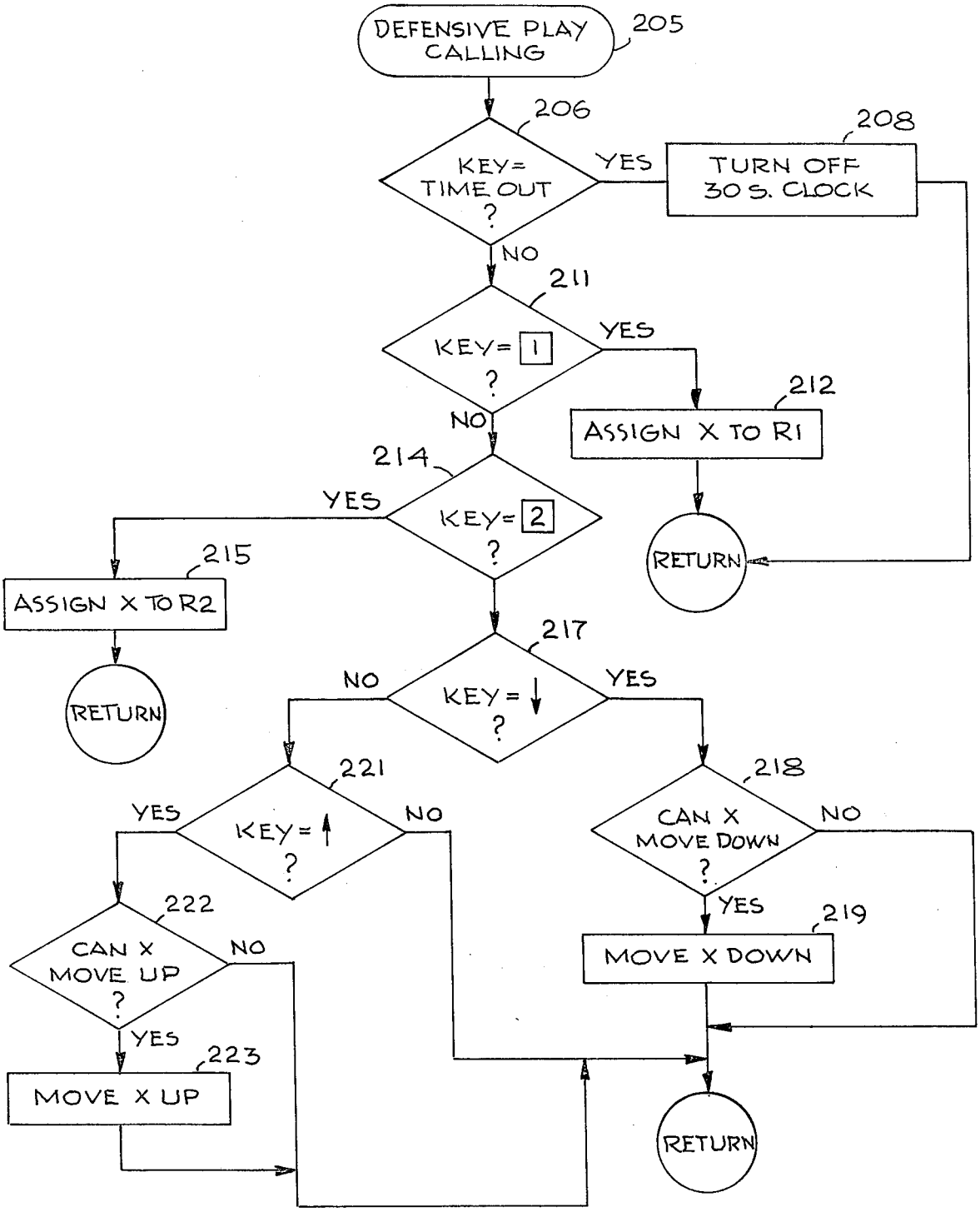
Figure 4K:
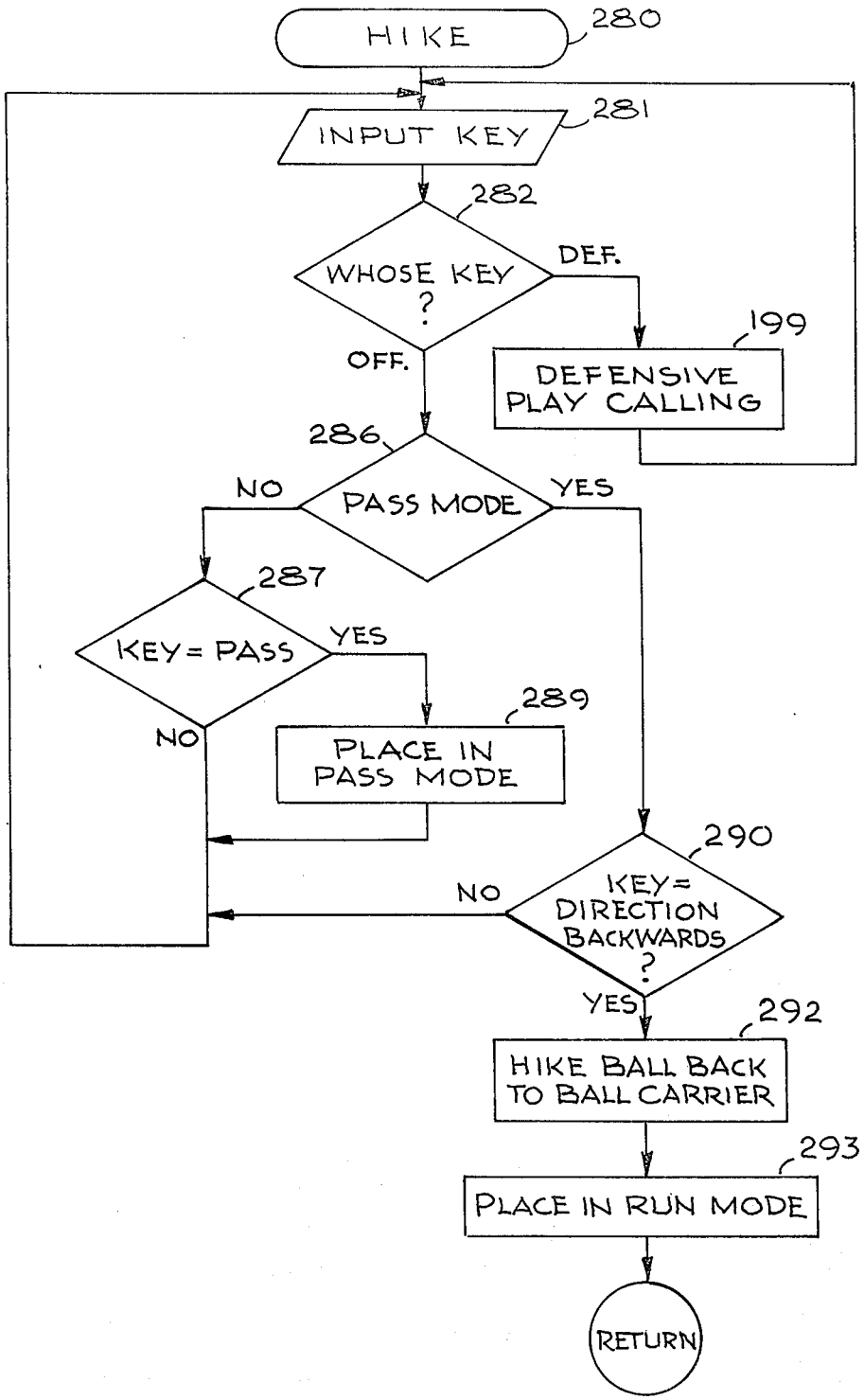
Figure 4L:
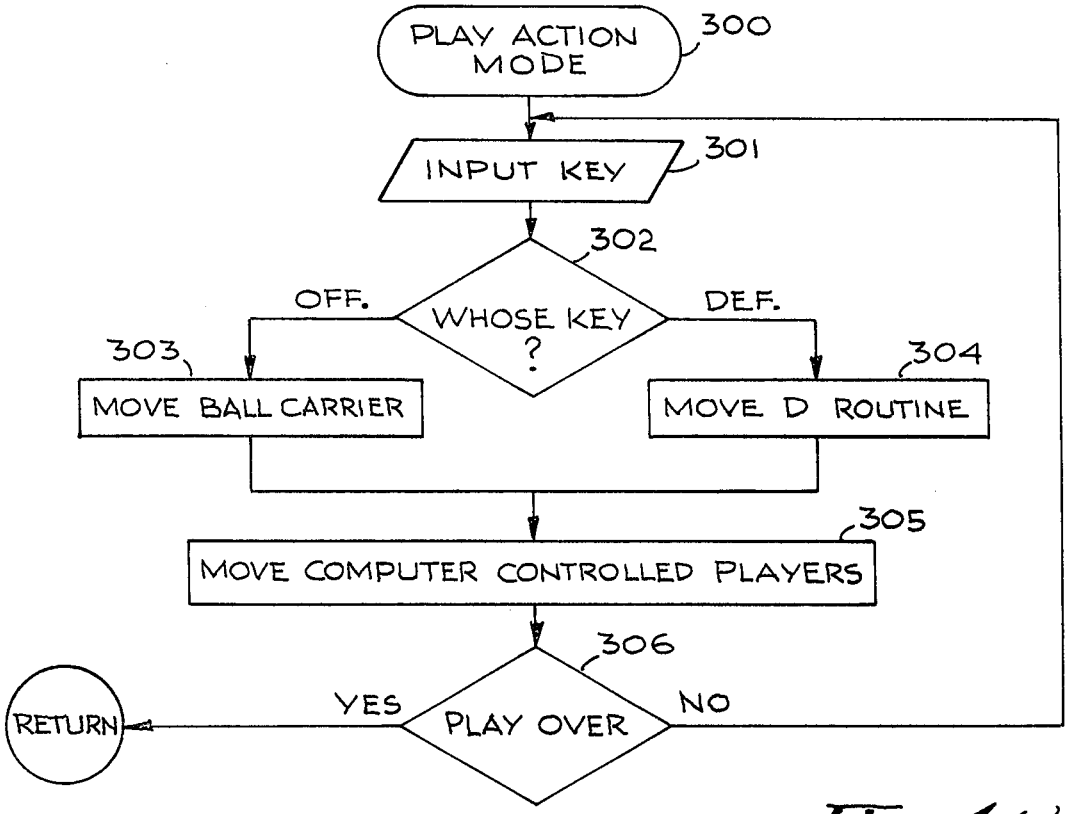
Figure 4O:
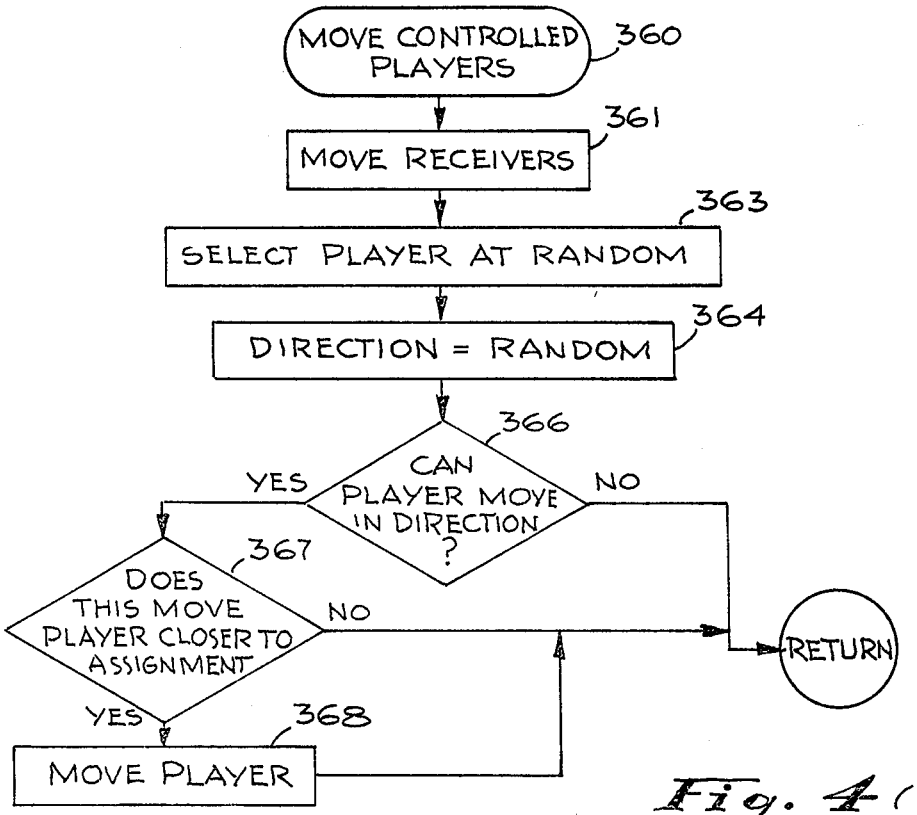
Figure 4:
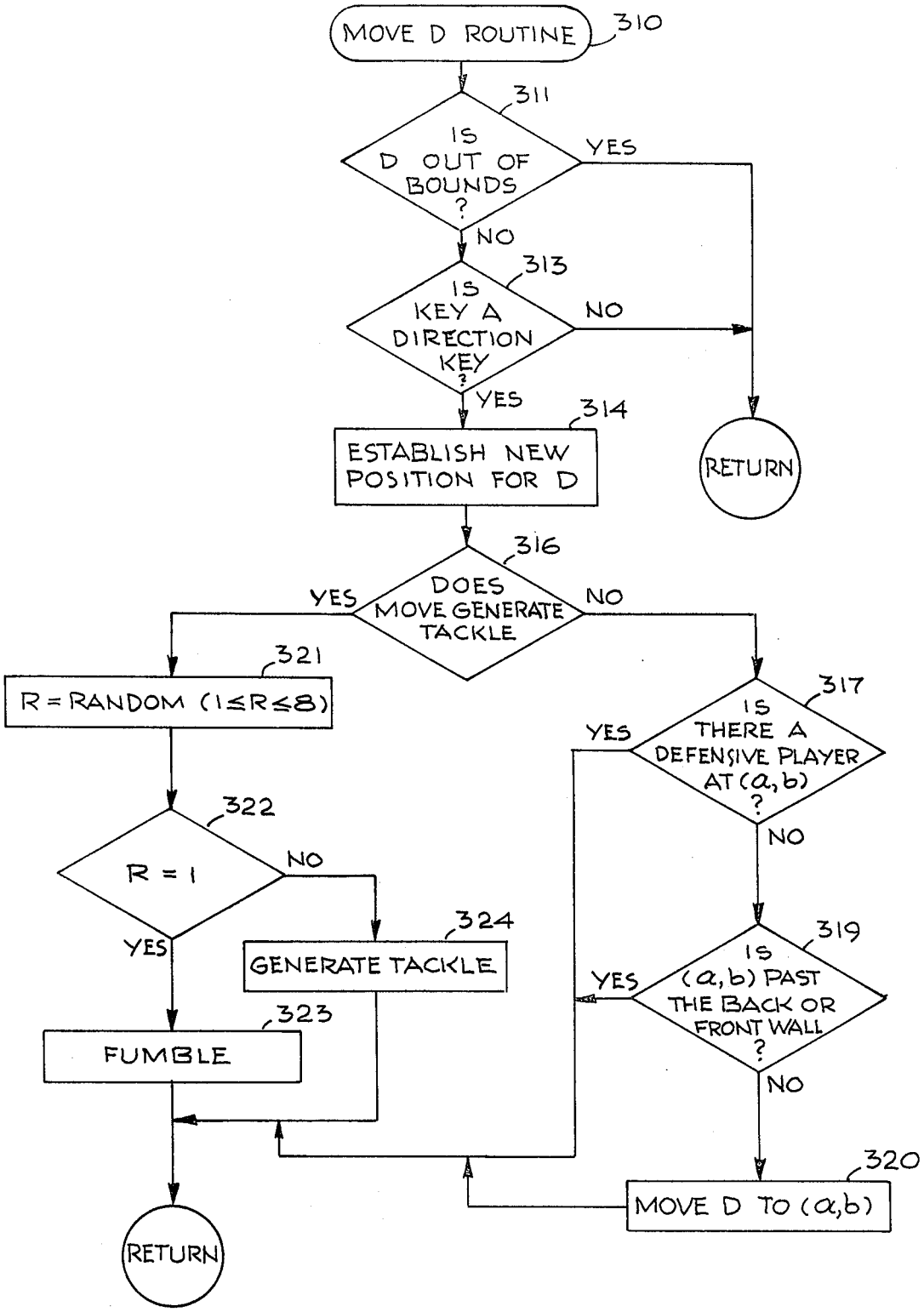
Figure 4N:
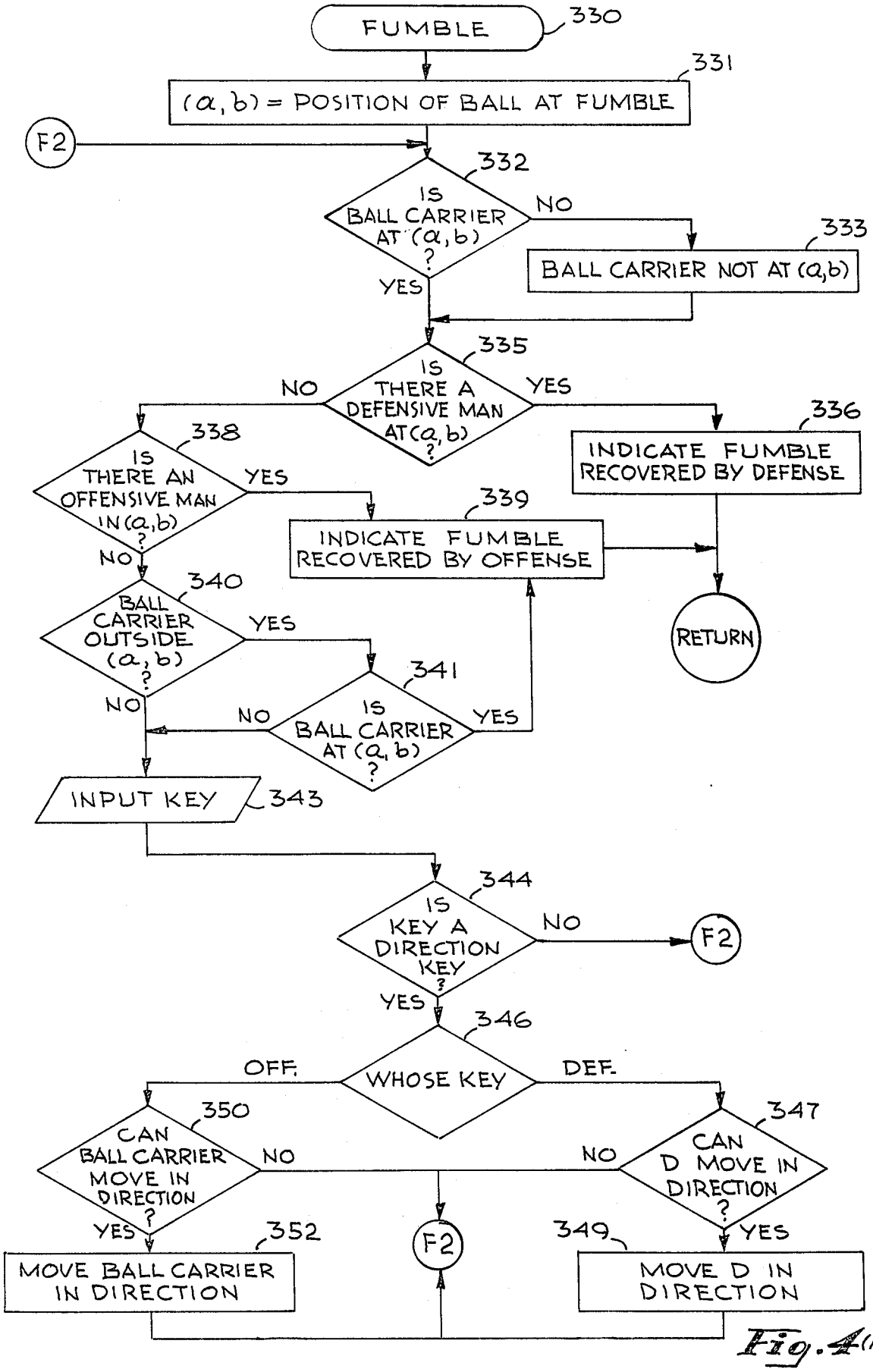
Figure 4:
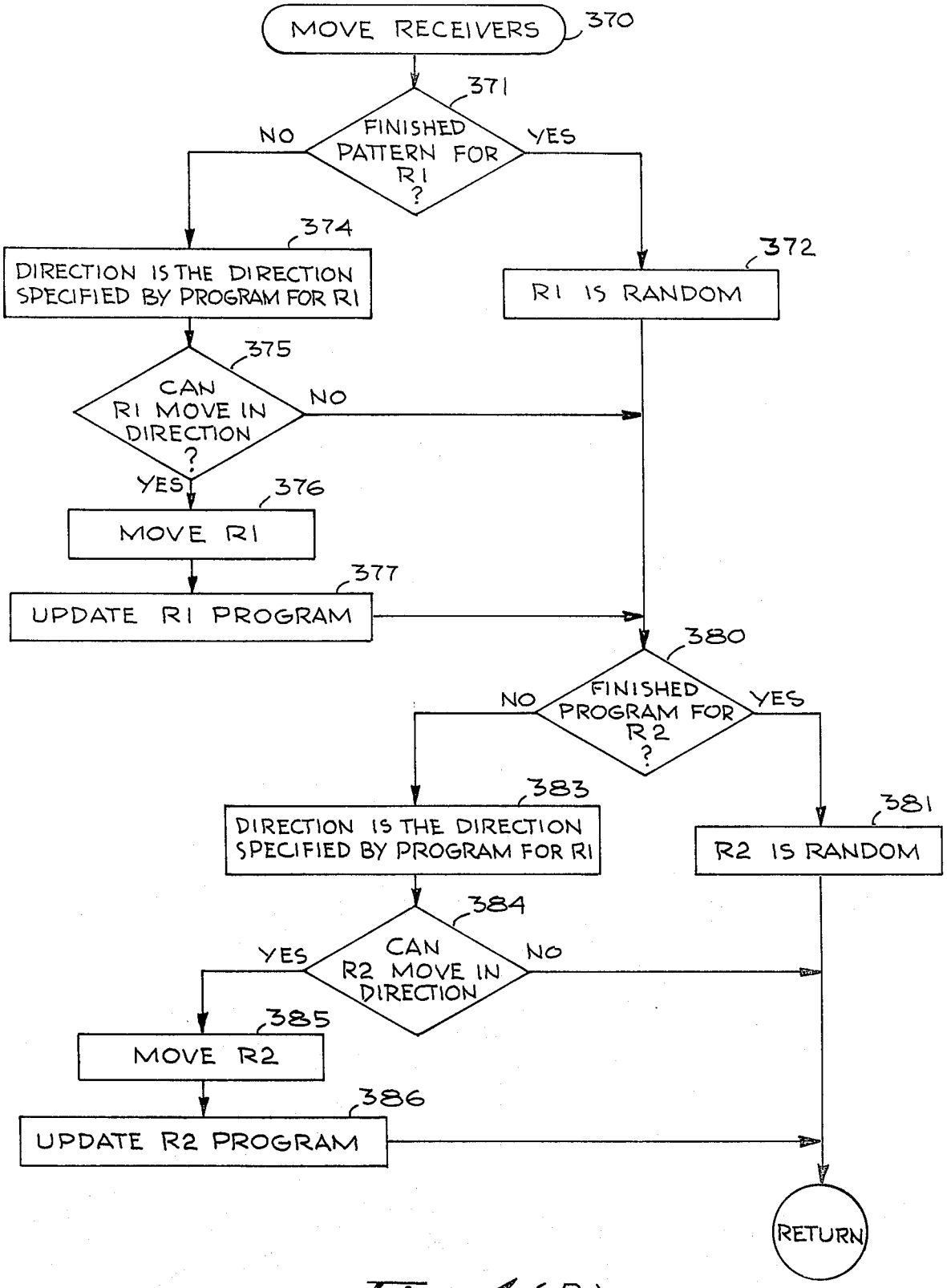
Figure 4:
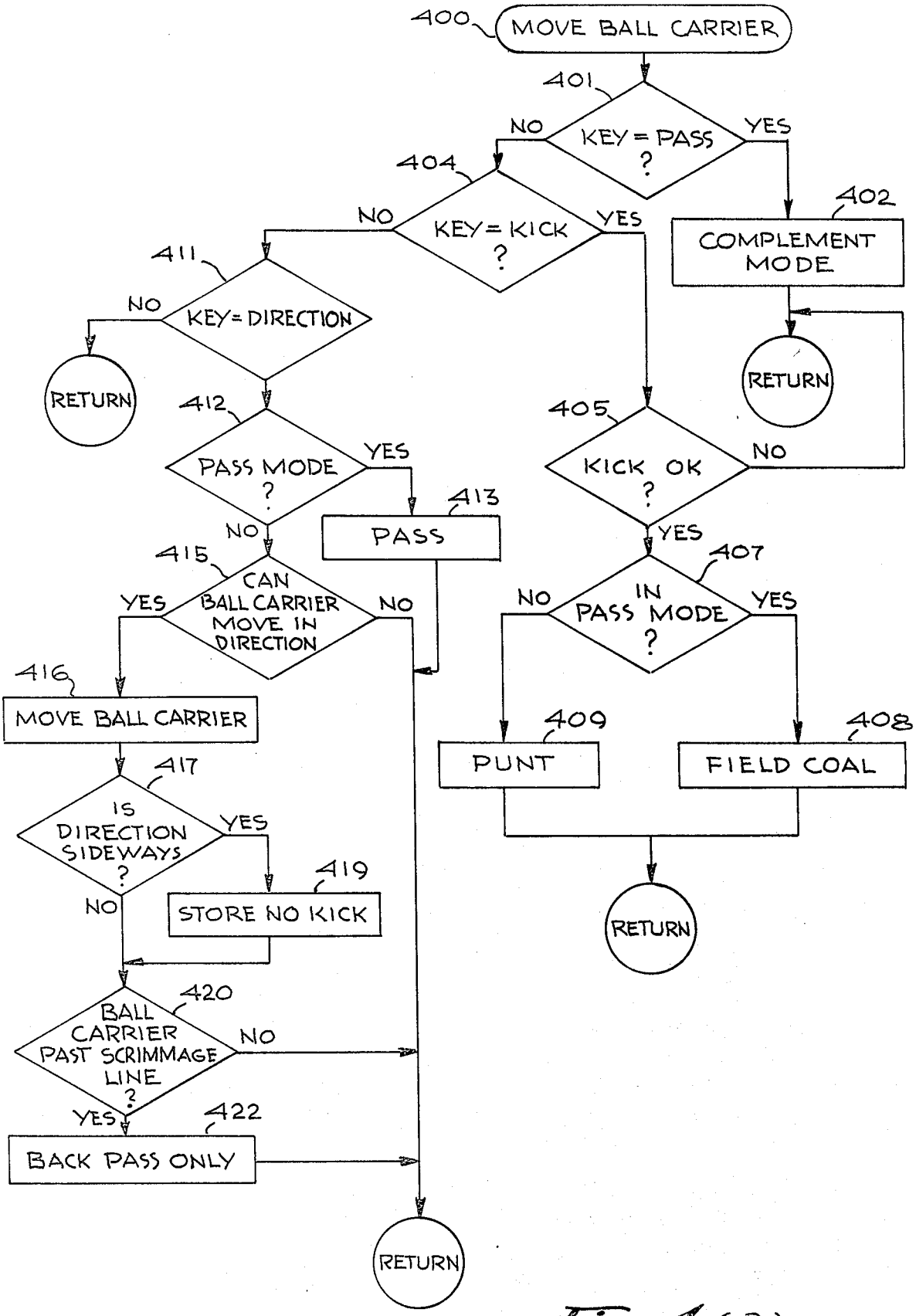
Figure 4R:
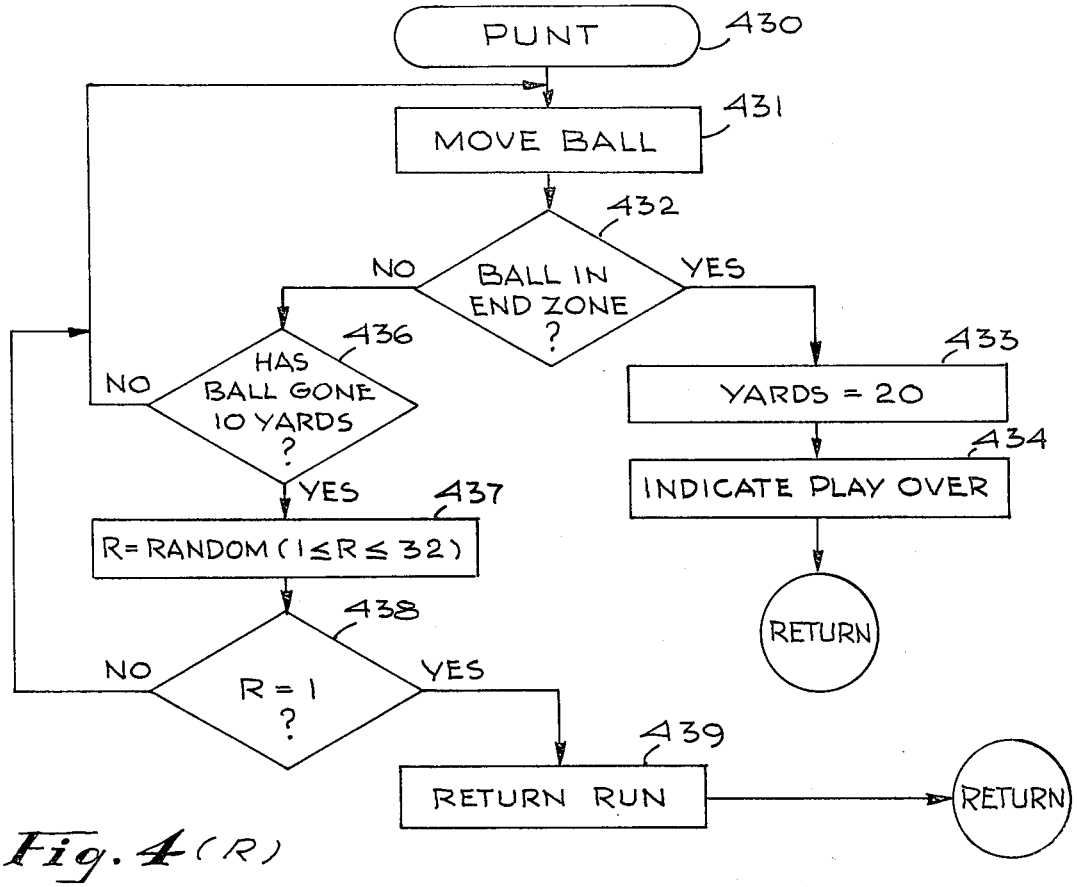
Figure 4S:
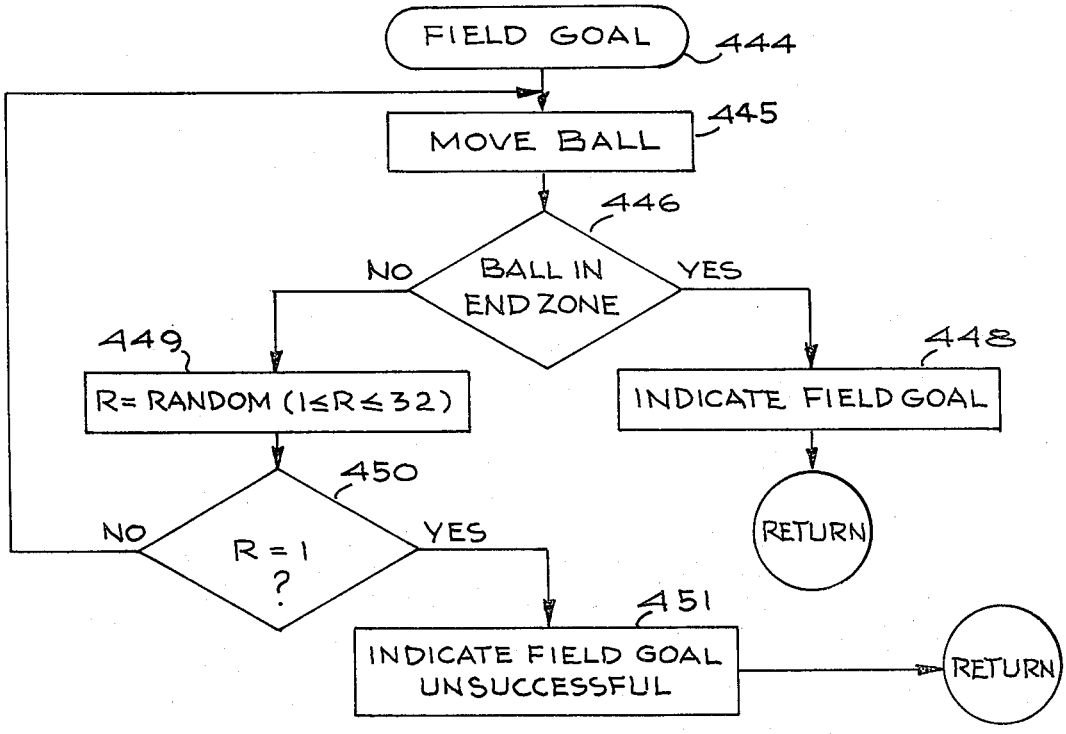
Figure 4U:
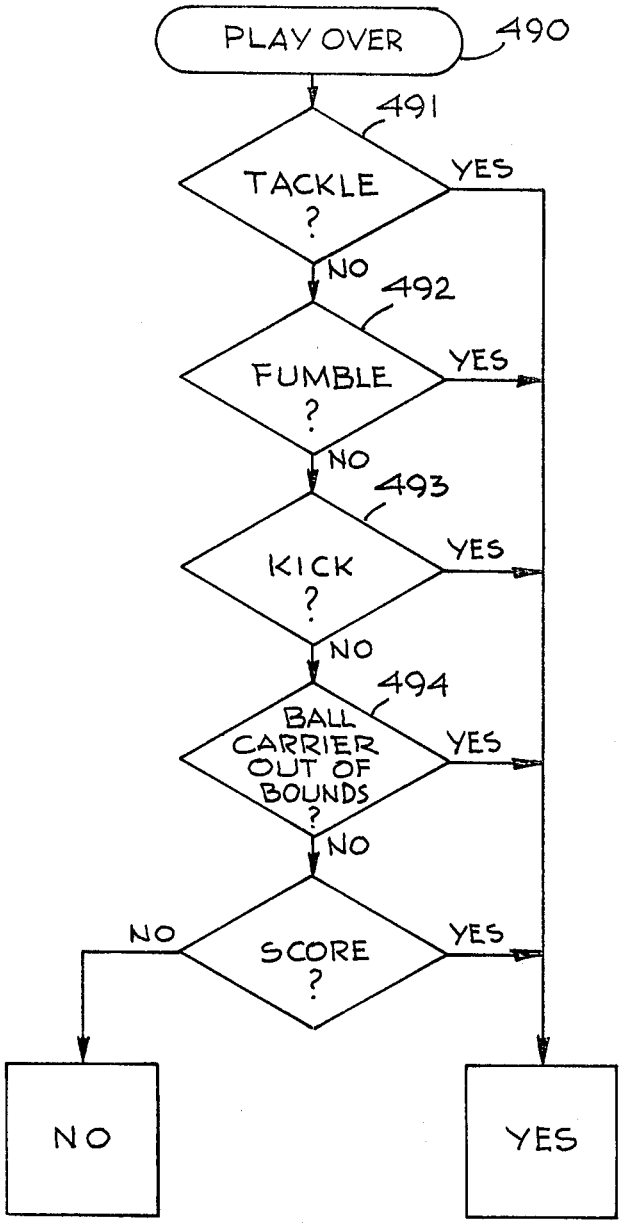
Figure 4V:
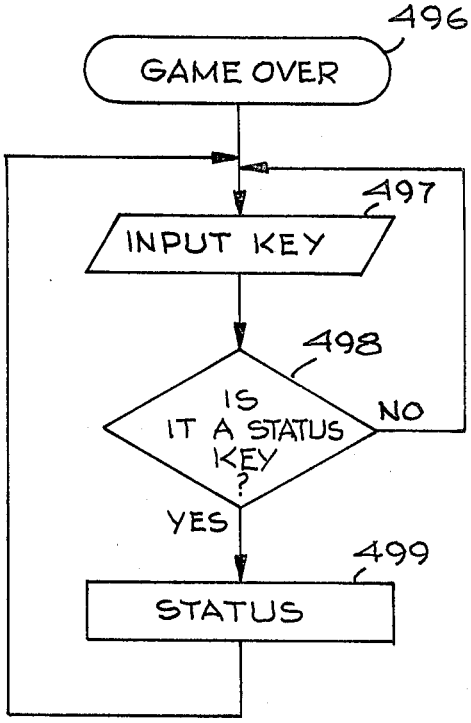

FIGS. 4(*a*)–4(*v*) together constitute a flow chart for the operation of the football game of this invention. FIG. 4(*a*) describes the overall operation of the football game while the other FIGS. 4(*b*)–4(*v*) describe subroutines for various steps shown on FIG. 4(*a*).

The flow chart of FIG. 4(*a*) is entered at step 50 when power is applied to the game by means of the off/on switch 44. The program moves immediately to step 51 at which the various components of the control circuits 45 and 46 are initialized and then moves directly to step 52 at which the two operators pick speeds at which the defensive linemen D1 and D2, the offensive linemen 01 and 02, the receivers R1 and R2, and the defensive back X move during the play of the game.

From step 52 the program moves to step 53 at which the offensive team kicks off the ball. The program then moves to step 54 during which the initial conditions for the next play are set up. From step 54, the program moves to step 55 which encompasses the play calling mode. After the play calling mode, the program moves to step 56 in which the ball is hiked by the offensive team. The program then moves to step 57 at which all play on display 14 takes place.

From step 57, the program moves to step 58 at which it is determined whether a score occurred on the particular play. If a score occurs on the particular play, the program moves to step 59 to determine whether the score was due to a touchdown. If so, the program recycles to step 54 to set up the conditions for a point after touchdown conversion attempt and recycles through the program. If no touchdown occurred at step 59, the program moves to step 60 to determine whether the game is over. If the game is not over, the program recycles to step 53 to set up a kickoff. If the game is over, the program moves to step 61 to end the game.

If at step 58 it is determined that no score has occurred, the program moves to step 62 to determine whether the game is over. If the game is over at step 62, the program moves to step 61 to end the game. If the game is not over at step 62, the program moves to step 63 to determine whether a half of the play has ended. If a half has not ended, the program recirculates to step 54 to set up the initial conditions for the next play. If the half has ended at step 63, the program recycles to step 53 to set up a kickoff for the second half or for the overtime period.

FIG. 4(*b*) illustrates a flow chart for the subroutine of the pick speeds step 52 illustrated in the flow chart of FIG. 4(*a*). The subroutine is entered at step 70 and moves immediately to step 71 at which the RAM memory of the control circuits 45 and 46 is initialized so that the status of the home speed, the visitors' speed, the home enter key, and the visitors' enter key are all set to zero. The program then moves to step 73 and awaits the depression of an input key. At this stage, a direction key 29–32 should be depressed to set a speed followed by the enter key 33. Consequently, the program next moves to step 74 at which it is determined whether the enter key 33 has been depressed.

If other than the enter key 33 has been depressed, the program moves to step 76 at which it is determined whether the key depressed is any of the direction keys 29–32. If other than one of the keys 29–32 is depressed, the program recycles to step 73 and awaits the depression of a correct input key. If one of the keys 29–32 is depressed at step 76, the program moves to step 77 to determine whether a home or visitors' direction key has been depressed. If a home key has been depressed, the program moves to step 78 at which it is determined whether the home speed selection has already been made and entered. If so, no further selection may be made by the operator of the home team as the program returns to step 73. If at step 78 the home speed selection has not been entered, the program moves to step 80 at which the particular speed selected by the operator of the home team is stored in memory. The program then recycles to step 73 to await the depression of either the enter key 33 or of another speed key by the home operator.

In like manner, if it is determined at step 86 that a visitors' direction key 29–32 has been depressed to select a speed of play, the program moves to step 81 to determine whether the visitors' speed has already been entered; and, if it has, the program recycles to step 73 to await the depression of a key by the home operator. If the visitors' speed has not already been entered at step 81, the program moves to step 82 to store in memory an indication of a particular speed selected by the operator of the visitors' team and then recycles to step 73 to await the depression of either another speed key or the enter key 33 by the operator of the visitors' team.

Once a speed has been selected by an operator and he depresses the enter key 33, the program moves from step 73 to step 74 and on to step 83 to determine whether the visitors' or the home enter key 33 is depressed. If the home enter key 33 is depressed, the program moves to step 84 while if the visitors' enter key 33 is depressed, the program moves to step 85. At step 84, it is determined whether the home speed has already been selected. The same determination is made as to the visitors' speed at step 85, and if either determination is that a direction key has not been depressed for either the visitor or the home team, the program recycles to step 73 to await the depression of a correct input key.

If it is found at step 84 that the home speed has been selected, the program moves to step 86 to store the selected home speed in memory. If at step 78 it is determined that the visitors' speed has been selected, the program moves to step 87 to store the selected visitors' speed in memory; if a visitor has not been selected, the program recycles to step 73. From each of steps 86 and 87, the program moves to a decision step 88 at which it is determined whether both the home and visitors' enter keys have been depressed. If both the home and visitors' speeds have been selected, the program exits the subroutine and returns to the kickoff step 53 illustrated in FIG. 4(*a*). If only one of the home or visitor enter keys 33 has been depressed, the program recycles to step 73 and awaits the depression of another input key.

FIG. 4(*c*) is a flow chart illustrating a subroutine for the kickoff step 53 illustrated in FIG. 4(*a*). The subroutine is entered at step 100 and moves immediately to step 101 at which an indication that an on-side kick has not been selected is stored in memory. The program then moves to step 103 at which it is determined whether the particular kick to be taken is a free kick from the twenty yard line after a safety scored by the defensive team. If such is the case, the program moves to step 104 to record the yard line as the twenty yard line for indication on the display 18. The program then moves to step 106 and awaits the depression of an input key. If at step 103 it is determined that the kick to be made is other than a kick after a safety, the program moves to step 107 to record the yard line from which the kick is to take place as the thirty-five yard line. The program then moves to step 106 and awaits the depression of an input key.

After depression of an input key at step 106, the program moves to step 109 where it is determined whether the key depressed is the pass key 38 of the offensive operator. If at step 109 it is determined that the offensive pass key 38 is depressed, the program moves to step 110 to store the status of the kick to be made as an on-side kick and recycles to step 106 to await the depression of another input key.

Thereafter, or if at step 106 in the first instance, other than the pass key has been depressed, the program moves from step 109 to step 112 at which it is determined whether the offensive kick key 36 has been depressed. If the kick key has not been depressed, the program recycles to step 106 to await the depression of a correct key (i.e., kick key 36). If at step 112 the kick key 36 has been depressed, the program moves to step 113 where it is determined whether the kick is an on-side or regular kickoff. If an on-side kick has been selected, the program moves to step 114 and executes an on-side kick. If the kick selected is a regular kickoff, the program moves to step 115 and executes a standard kick-off. From either step 114 or step 115, the program exits the subroutine and moves to step 54 of the flow chart illustrated in FIG. 4(*a*).

FIG. 4(*d*) illustrates a flow chart for the subroutine for executing an on-side kick for step 114 of the flow chart of FIG. 4(*c*). The subroutine is entered at step 117 and moves immediately to step 118 at which the speaker 16 of the game is caused to emit a kickoff song. The program then moves to step 120 in which the offensive players are moved sequentially through columns 1, 2, 3, and 4 until they reach the line of scrimmage and the ball is kicked as explained above. The program then moves to step 121 at which the ball is moved by one space on the display toward the receiving team's goal and to step 122 where the yardage is updated for the display 18.

The program then moves to step 124 to determine whether the ball has reached the fifty yard line. If the ball has not reached the fifty yard line at step 124, the program recycles to step 121; and the ball is moved to another space on the display 14. If the ball has reached the fifty yard line at step 124, the program moves to step 125 to start the game clock and then to step 126 at which display 14 is caused to provide the on-side kick receipt formation referred to above in which two offensive and two defensive players each assigned to the ball appear in the four corners of the display 14. The program then moves to step 128 at which a random one of the four men is selected for movement and to step 129 at which a random direction for that player's movement is selected. The program then moves to step 130 at which it is determined whether moving the selected player in the direction selected at step 129 moves that player closer to the ball. If at step 130 it is determined that the player moves no closer to the ball, the program skips the move and recycles to step 128 to select another player for movement.

If at step 130 it is determined that the direction selected at step 129 moves the particular player selected at step 128 closer to the ball, the program moves to step 132 to implement the move of the particular player. The program then moves to step 133 to determine whether the player moved is at the same point as the ball. If the player is not at the same point as the ball, the program recycles to step 128 to select another player at random for movement toward the ball and recycles through the program.

If it is determined at step 133 that the selected player is at the same point as the ball, the program moves to step 135 to stop the game clock, to step 136 to store an indication that the particular player's team is in possession of the ball and consequently on offense, to step 137 to record the down for the display 18 as first down, and to step 138 to record the yards to go for display on the display 18 as ten yards. The program then exits the subroutine and proceeds to step 54 illustrated in FIG. 4(*a*).

FIG. 4(*e*) illustrates a flow chart for the subroutine of step 115 of the flow chart shown in FIG. 4(*c*) in which the kickoff routine for a regular kickoff is executed. The subroutine is entered at step 150 and moves immediately to step 151 at which the kickoff song is sounded. The program then moves to step 152 at which the sequential movement of the offensive players from column one to the line of scrimmage at column four is executed. The program then moves to step 154 at which the ball is moved one space toward the receiving team on display 14 and to step 155 at which the yard line where the ball is now situated is updated.

The program moves from step 155 to step 156 at which it is determined whether the ball has advanced more than twenty-five yards. Since the ball must travel at least twenty-five yards on a regular kickoff, if the ball has not advanced to this point at step 156, the program recycles to step 154 and the ball is advanced as explained above. If at step 156 it is determined that the ball has advanced more than twenty-five yards, the program moves to step 158 in which a random number is generated which will average twenty over an extended period. From step 158, the program moves to step 159 at which it is determined whether the random number generated at step 158 is zero (another number might as well be used). If the number is not zero, then the kick proceeds; and the program moves to step 161 to determine whether the ball is yet in the end zone. If the ball is not in the end zone at step 161, the program recycles to step 154 to continue moving the ball one step at a time. If the ball is in the end zone at step 161, the program moves to step 162 to record the down as first down, to step 164 to record the yards to go as ten yards, and then returns to step 54 shown in FIG. 4(*a*).

If at step 159 it is determined that the random number selected at step 158 was zero, the program moves to terminate the flight of the ball and to generate a ball carrier on the display 14 at step 165. The program moves from step 165 to step 167 at which the return run of the ball carrier is carried out by the operator of the receiving team which is now on offense. From either step 164 or step 167, the program returns to step 54 illustrated in the flow chart of FIG. 4(*a*).

FIG. 4(*f*) illustrates a flow chart for a subroutine of step 167 shown in FIG. 4(*e*) in which the execution of the return run of the ball carrier takes place. The subroutine is entered at step 170 and moves immediately to step 171 to await the depression of an input key. From step 171 when a key is depressed, the program moves to step 173 at which it is determined whether the key depressed is both controlled by the new offensive operator and is one of the keys 39–42 which indicate the direction in which the ball carrier under control is to move. Presuming that an offensive key 39–42 is depressed, the program moves to step 174 to move the ball carrier and the ball in the direction indicated by the depressed key.

From step 174 and from step 173 if an inappropriate key has been depressed, the program moves to step 176 to determine whether there are presently four defensive players displayed on the screen of the display 14. If there are less than four defensive players on display 14, the program moves to step 177 to select a random location and then to step 178 to determine whether there is already a defensive player at the selected location. If there is a defensive player at this location, no additional defensive player is created during this cycle of the operation. If there is no defensive player already at the selected location, the program moves to step 180 to create a defensive player at the selected location.

From step 176 if there are already four defensive players on display 14, from step 178 if there is already a defensive player at the selected location, and from step 180, the program moves to step 181 to select at random a particular defensive player to move and to select a random direction for that player to move. From step 181 the program moves to step 183 to determine whether moving the particular player in the direction selected places that player closer to the ball. If the move places the player closer to the ball, the program moves from step 183 to step 184 to move the player in the selected direction.

From step 184 and from step 183 if the selected move does not place the player selected closer to the ball, the program moves to step 185 to determine whether a tackle occurred on the particular move because the ball carrier and a defenseman are attempting to occupy the same position. If a tackle occurred at step 185, the program exits the subroutine and moves to step 54 shown in FIG. 4(*a*). If a tackle did not occur on the particular cycle, the program moves to step 186 to determine whether a touchdown occurred. If a touchdown occurred at step 186, the program exits the subroutine and moves to step 54 shown in FIG. 4(*a*). If a touchdown did not occur at step 186, the program recycles to step 171 to await the depression of another input key for further moving the ball carrier and the ball.

FIG. 4(*g*) illustrates a flow chart for the subroutine of the play calling mode step 55 shown in FIG. 4(*a*). The subroutine is entered at step 190 and moves directly to step 192 at which it is determined whether the thirty second play calling clock should be started or not. It will be recalled that the thirty second play calling clock is normally started at the beginning of each play calling mode. However, in certain instances such as when a pass is dropped or the ball carrier goes out of bounds, the thirty second clock is not used. If the clock is not used, the program moves immediately to step 193 to await the depression of an input key. If the clock is started, the program moves to step 195 to turn on the thirty second play calling clock and then moves to step 193.

When an input key has been depressed at step 193, the program moves to step 195 to determine whether the depressed key controls the offense, the defense, or neither. If the key depressed is one of the keys 20–23, the program moves to step 197 during which information regarding the status of the game is displayed during the time a particular key is being depressed. The program then recycles to step 193 and awaits the depression of another input key.

If at step 195 an offensive play calling key has been depressed, the program moves to step 198 during which offensive play calling is accomplished. If, on the other hand, the play calling key is operated by the defensive operator, the program moves to step 199 to accomplish the defensive play calling. From each of steps 198 and 199 the program moves to step 200 at which it is determined whether all the play calling has been accomplished. If so, the program exits the subroutine and returns to step 56 shown in FIG. 4(*a*) to await the hike of the ball. If at step 200 it is determined that play calling is not yet complete, the program moves to step 201 to determine whether the play calling clock has been decremented to zero. If the play calling clock has not been decremented to zero, the program recycles to step 193 and awaits the depression of another input key. If the thirty second play calling clock has been decremented to zero at step 201, the program moves to step 202 to access a penalty and recycles to step 193 to await the depression of another input key. The program continues to recycle through steps 193 until it is determined at step 200 that play calling has been completed whereupon the program exits the subroutine and moves to step 56 shown in FIG. 4(*a*).

FIG. 4(*h*) illustrates a flow chart of a subroutine for step 199 shown in FIG. 4(*g*) in which defensive play calling is accomplished. The subroutine is entered at step 205 and proceeds immediately to step 206 at which it is determined whether the time out key 37 has been depressed. If so, the program moves to step 208 to turn off the thirty second clock and exits the subroutine. If not, the program moves to step 211 to determine whether the number one key 26 has been depressed. If the key 26 has been depressed, the program then moves to step 212 to accomplish the assignment of the defensive back X to the receiver R1. The program then exits the subroutine and returns to step 200 shown in FIG. 4(*g*).

If at step 211 the key 26 has not been depressed, the program moves to step 214 to determine whether the number two key 27 has been depressed. If the key 27 has been depressed, the program moves to step 215 to assign the defensive back X to the receiver R2. The program then exits the subroutine and moves to step 200 shown in FIG. 4(*g*).

If at step 214 the key 27 has not been depressed, the program moves to step 217 to determine whether the down key 31 has been depressed. If the key 31 has been depressed, the program moves to step 218 to determine whether the defensive back X can be moved down by one row. If the move can be made, the program moves to step 219 to move the defensive back X to a position one row below his previous position. The program then exits the subroutine and moves to step 200 shown in FIG. 4(*g*). If X cannot be moved in a down at step 218 because the position is out of bounds, the program bypasses step 219 and exits the subroutine.

If at step 217 the down key 31 has not been depressed, the program moves to step 221 to determine whether the up key 29 has been depressed in order to move the defensive back X upward. If the key 29 has not been depressed, the program exits the subroutine and moves to step 200 shown in FIG. 4(*g*). If the key 29 has been depressed, the program moves to step 222 to determine whether the defensive back X can be moved upward. If the defensive back X cannot be moved upward, the program exits the subroutine and moves to step 200 shown in FIG. 4(*g*). If the defensive back X can be moved upward, the program moves to step 223 to accomplish this move and then exits the subroutine and moves to step 200 shown in FIG. 4(*g*).

FIG. 4(*i*) illustrates a flow chart for the subroutine of the penalty step 202 shown in FIG. 4(*g*). The subroutine is entered at step 230 and moves immediately to step 231 at which the game clock is stopped. The program then moves to step 232 to determine whether play is taking place between the goal and ten yard line or not. If play is taking place between the goal and the ten yard line, the program moves to step 233 at which a penalty of one-half the distance to the goal line is assessed. If play is taking place at or beyond the ten yard line, the program moves to step 234 at which a penalty of five yards is assessed. During each of steps 233 and 234, the position of the ball is changed on the display 18 by the amount of the penalty assessed. In each of steps 233 and 234, the particular penalty to be assessed is shown on display 18 (as indicated above in the specification) as well as the ultimate position of the ball.

From each of steps 233 and 234, the program moves to step 236 at which the play calling mode is restarted without restarting the play calling clock. The program then moves to step 238 and awaits the depression of a status key 20–23. Once a status key 20–23 has been depressed, the program moves to step 239 and then returns to await the depression of an input key at step 193 shown in FIG. 4(*g*). If a key other than a status key 20–23 is depressed at step 238, the program moves from step 239 and recycles to step 238 to await the depression of one of the status keys 20–23 before proceeding with the play calling mode.

FIG. 4(*j*) illustrates a flow chart of a subroutine for the offensive play calling step 198 shown in FIG. 4(*g*). The subroutine is entered at step 250 and proceeds directly to step 251 at which it is determined whether both of the offensive receivers R1 and R2 have already been programmed. If the receivers R1 and R2 have been programmed, the program exits the subroutine and returns to step 200 shown in FIG. 4(*g*).

If at least one of the receivers has not yet been programmed at step 251, the program moves to step 253 at which it is determined whether the number one key 21 has been depressed to enter the subroutine. If the number one key 26 has not been depressed, the program moves to step 254 to ask whether the number two key 27 has been depressed. If at step 253 the number one key 21 has been depressed, the program moves to step 255 to store the information in memory that the receiver R1 is presently being programmed. If the number two key 27 has been depressed at step 254, the program moves to step 256 to store the information in memory that the number two receiver R2 is being programmed. From each of steps 255 and 256, the program moves to step 258 to store in memory an indication that no direction changes have yet been recorded for the particular receiver R1 or R2 presently being programmed, and to establish certain other initial conditions. The program then exits the subroutine.

Once either the number one key 26 or the number two key 27 has been depressed to indicate the particular receiver R1 and R2 being programmed, the subroutine of FIG. 4(*j*) is next utilized when a move for the selected receiver is entered by depressing one of the direction keys 28–32. When one of the direction keys 28–32 is depressed, the program moves through steps 251, 253, and 254 to a step 259 at which it is determined whether one of the keys 26 or 27 has yet been depressed. If neither key 26 or 27 has yet been depressed, the program exits the subroutine.

Presuming that one of the two keys 26 or 27 has been depressed, the program moves to step 260 to determine whether the enter key 33 has been depressed. As explained above, it is possible to program a receiver R1 or R2 for random movement by depressing the appropriate one of keys 26 or 27 followed by the enter key 33. However, this is unusual and presuming that a direction key has been depressed, the program moves to step 261 to ask whether this is the pause key 28. If the pause key 28 has been depressed, the program moves to step 262 at which this information that the receiver being programmed is to pause for one cycle is recorded in memory. If the pause key 28 has not been depressed at step 261, the program moves to step 263 to ask whether one of the direction keys 29–32 has been depressed. If none of these keys has been depressed, the program moves to step 262 to see if the time out key 37 has been depressed; if key 37 has been depressed, the program moves to step 265 to stop the thirty second clock and exits from the subroutine. If the key 37 is not depressed at step 262, the program exits the subroutine. If one of the keys 29–32 has been depressed, the program moves to step 264 at which it is determined whether four direction changes have already been recorded for the particular receiver R1 or R2. The program also moves to step 264 from step 262.

If at step 264 it is determined that four direction changes have already been recorded, the program exits the subroutine. If at step 264 it is determined that less than four direction changes have been recorded, the program moves to step 266 at which it is determined whether the key presently depressed is the same key as was depressed on the last cycle through the program.

This determination is made because a direction key may be depressed as many times as is desired so long as only four changes of direction are made. If the same key 28–32 is presently being depressed as was depressed on the last cycle, the program moves to step 267 to store the information that an additional step is being added to the particular direction and exits the subroutine. If at step 266 it is determined that a different key is depressed on this cycle than was depressed on the last cycle through the subroutine, the program moves to step 268 to set the count for the particular direction as one, to step 269 to store in memory the particular direction in which the move is to be made, and to step 270 to add one to the number of direction changes presently stored. The program then exits the subroutine.

Once a receiver has been selected and his direction of movement programmed, the subroutine of FIG. 4(*j*) is utilized when the enter key 33 is depressed. The program moves through steps 251, 253, 254, and 259 to step 260 at which it is determined whether the enter key 33 has been depressed. If the enter key 33 has been depressed, the program moves to step 272 at which a record is made in memory that the particular receiver R1 or R2 has been programmed. The program then moves to step 273 at which an indication is stored in memory that the control circuitry is ready to receive a program for the second one of the receivers. The program then exits the subroutine.

FIG. 4(*k*) illustrates a flow chart of a subroutine for the hike step 56 shown in FIG. 4(*a*). The subroutine is entered at step 280 and moves directly to step 281 at which it awaits the depression of an input key. Upon the depression of an input key, the program moves to step 282 to determine whether the offensive or the defensive operator has depressed the key. If the defensive operator has depressed the key at step 282, the program moves to step 199 at which the subroutine for defensive play calling is effected as explained above. This allows the defensive operator to change his programming until a hike occurs. The program then returns to step 281 to await the depression of another input key.

If at step 281 an offensive input key is depressed, the program moves through step 282 to a step 286 to determine whether the pass key 38 has already been depressed so that the game is in the pass mode. If the pass key 38 has not been depressed, the program moves to step 287 to determine whether the key presently being depressed is the pass key 38. If the pass key 38 is not presently being depressed, the program recycles to step 281 and awaits the depression of another input key. If at step 287 the pass key 38 is presently being depressed, the program moves to step 289 to place the game in the pass mode and recycles to step 281 to await the depression of another input key.

If at step 286 the program is already in the pass mode, the program moves to step 290 to determine whether the key presently depressed is a direction key for a backward pass which is the first key depressed in order to cause a hike to occur. If such a key is not presently being depressed, the program recycles to step 281 and awaits the depression of such a key. If at step 290 the key presently being depressed is either the key 40 or the key 42 (depending on the team on offense), the program moves to step 292 to cause the ball to be hiked back to the ball carrier (the quaterback Q). The program then moves to step 293 to place the game in the run mode and then exits the subroutine.

FIG. 4(*l*) illustrates a flow chart of a subroutine for the play action mode step 57 shown in FIG. 4(*a*). The subroutine is entered at step 300 and moves directly to step 301 at which the depression of an input key is awaited. Once a key is depressed the program moves to step 302 to determine whether the key depressed is controlled by the offensive operator or the defensive operator. If the key depressed is controlled by the offensive operator, the program moves to step 303 at which the movement of the ball carrier takes place. If the key depressed is operated by the defensive operator, the program moves to step 304 at which the movement of the defensive back D take place. From each of steps 303 and 304, the program moves to step 305 to execute the subroutine for moving those players of both the offense and the defense which are controlled in their movements by the control circuitry of the game. As will be recalled, this includes the offensive linemen 01 and 02, the receivers R1 and R2, the defensive linemen D1 and D2, and the defensive back X.

After step 305, the program moves to step 306 to determine whether the play presently taking place on the display 14 is over. If the play is not over, the program recycles to step 301 to await the depression of another input key. If the particular play is over, the program exits the subroutine and returns to step 58 of the flow chart shown in FIG. 4(*a*).

FIG. 4(*m*) shows a flow chart of a subroutine for moving the defensive safety D illustrated as step 304 in FIG. 4(*l*). The subroutine is entered at step 310 and moves directly to step 311 where a determination is made as to whether the defensive safety D is presently out of bounds. If the defensive safety D is out of bounds at step 301, the program exits the subroutine. If the defensive safety D is not out of bounds at step 311, the program moves to step 313 to determine whether the key presently being depressed is a direction key 39–42. If such a key is not being depressed, the program exits the subroutine.

If a direction key is being depressed at step 313, the program moves to step 314 to establish the new position for the defensive safety D in accordance with the direction key depressed. The program then moves to step 316 to determine whether the move generates a tackle (i.e., whether the defensive safety D and the ball carrier fall in the same position of display 14 when the move is made). If the move does not generate a tackle at step 316, the program moves to step 317 to determine whether there is a defensive lineman D1 or D2 or back X at the selected position. If such a defenseman is at the selected position, then the move cannot be made and the program exits the sub-routine.

If at step 317 there is no defensive man at the selected position, the program moves to step 319 to determine whether the selected position is beyond the ends of the display 14. If the position is beyond the ends of the display 14, the move cannot be made; and the program exits the subroutine. If the selected position is not off the display 14 at step 319, the program moves to step 320 to execute the move of the defensive safety D to the new position and exits the subroutine.

If at step 316 the selected move of the defensive safety D would generate a tackle, the program moves to step 321 to generate a random number between one and eight and then to step 322 to determine whether the number selected is one. If the number selected is one at step 321, the program moves from step 322 to step 323 to generate a fumble. Thus, in one out of eight cases when a tackle is made by the defensive safety D, a fumble takes place. The program then exits the subroutine. If at step 322 it is determined that the random number selected was not one, the program moves to step 324 to generate a tackle of the ball carrier and exits the subroutine.

FIG. 4(*n*) illustrates a flow chart of a subroutine for the fumble step 323 illustrated in FIG. 4(*m*). The subroutine is entered at step 330 and proceeds immediately to step 331 at which the position of the ball at the fumble is stored in memory. The program then moves to step 332 to determine whether the ball carrier is presently at the position of the fumble. If the ball carrier is not at the position of the fumble, this fact is stored in memory at step 333 so that the ball carrier need only enter the position at which the ball was fumbled in order to recover it.

From step 333 and from step 332 if the ball carrier is at the position of the fumble, the program moves to step 335 to determine whether a defensive man is positioned at the position of the fumbled ball. If a defensive man is positioned where the fumble occurs, the program moves to step 336 to indicate the fumble has been recovered by the defense and exits the subroutine. If there is no defensive man at the position of the fumble, the program moves to step 338 to determine whether one of the offensive men (other than the ball carrier) is at the position of the fumble. If an offensive man is at the position of the fumble, the program moves to step 339 to indicate that the fumble has been recovered by the offense and exits the subroutine.

If at step 388 there is not an offensive man at the position of the fumble, the program moves to step 340 to determine whether the position of the ball carrier was previously stored as being outside of the position at which the fumble took place. If so, the program moves to step 341 to determine whether the ball carrier is at the position of the fumble, and to step 339 to indicate that the fumble was recovered by the offense if the ball carrier is at the position of the fumble at step 341. The program then exits the subroutine. If at step 341 the ball carrier is not at the position of the fumble, the program moves to step 343 to await the depression of an input key.

When an input key is depressed at step 343, the program moves to step 344 to determine whether the key depressed is a direction key. If a direction key is not being depressed at step 344, the program recycles to step 332 to recycle through the program. If a direction key is being depressed at step 344, the program moves to step 346 to determine whether the operator of the offense or the defense is depressing the key. If the defensive operator is depressing the key at step 346, the program moves to step 347 to determine whether the defensive safety D can move in the direction selected. If the defensive safety D cannot move in the direction selected, the program recycles to step 332. If the defensive safety D can move in the direction selected, the program moves to step 349 to move the defensive safety D in the selected direction and then recycles to step 332.

If at step 346 it is determined that the key depressed belongs to the offensive operator, the program moves to step 350 to determine whether the ball carrier can be moved in the direction selected. If the ball carrier cannot move in the selected direction, the program recycles to step 332. If the ball carrier can move in the selected direction, the program moves to step 352 to move the ball carrier in the selected direction and then recycles to step 332. The program recycles through the subroutine until the fumble is recovered by either an offensive or defensive man and then exits the subroutine.

FIG. 4(*o*) illustrates a flow chart for a subroutine for implementing the step 305 shown in FIG. 4(*l*) in which the moves of the players advanced by the control circuitry are executed. The subroutine is entered at step 360 and moves directly to step 361 in which receivers R1 and R2 are moved in accordance with a subroutine to be explained below. From step 361, the program moves to step 363 to select at random a particular offensive or defensive player to move. It should be noted that once a receiver R1 or R2 has completed its pattern, it falls in the category of players selectable at step 363.

From step 363, the program moves to step 364 to select at random a direction for movement of the selected player. From step 364, the program moves to step 366 to determine whether the player selected can move in the selected direction. If the player cannot make the move because it is out of bounds or because another player through which the selected player cannot move is in the way, the program exits the subroutine. If at step 366 the selected player can make the move, the program moves to step 367 to determine whether the move causes the player to move closer to the assigned target for that player. If the move does not move the selected player closer to the assigned target, the program exits the subroutine. If the move does move the player closer to the assigned target, the program moves to step 368 to execute the move of the particular player and exits the subroutine.

FIG. 4(*p*) illustrates a flow chart of a subroutine for effecting the move receivers step 361 shown in FIG. 4(*o*). The subroutine is entered at step 370 and moves directly to step 371 at which it is determined whether the pattern programmed for the receiver R1 has been completely run or not. If the pattern for the receiver R1 has been completed, the program moves to step 372 to store in memory information that the receiver R1 is now moved randomly in accordance with the move controlled players subroutine shown in FIG. 4(*o*).

If at step 371 it is determined that the pattern for the receiver R1 has not yet been completed, the program moves to step 374 to set the direction for movement of the receiver R1 as that specified by the program for the receiver R1. The program then moves to step 375 to determine whether the receiver R1 can move in the selected direction. If the receiver R1 can move in the selected direction, the program moves to step 376 to move the receiver R1 and to step 377 to store in memory an indication that the particular step of the pattern has been completed.

From steps 372 and 377 and from step 375 if the receiver R1 cannot move in the selected direction, the program moves to step 380 at which it is determined whether the pattern for the receiver R2 has been completed. If the pattern for the receiver R2 has been completed, the program moves to step 381 to store in memory the information that the receiver R2 is now to move randomly in accordance with the flow chart shown in FIG. 4(*o*) and, more particularly, will be randomly selected to move at step 363 as is shown therein. From step 381, the program exits the subroutine and moves to step 363 of the subroutine shown in FIG. 4(*o*).

If at step 380 it is determined that the pattern for the receiver R2 has not been completed, the program moves to step 383 to set the direction specified by the program as the direction for the receiver R2 to move at this particular cycle. The program then moves to step 384 to determine whether the receiver R2 can move in the particular direction. If the receiver R2 cannot make the particular move, the program exits the subroutine and moves to step 363 of the subroutine shown in FIG. 4(*o*). If the receiver R2 can move in the selected direction, the program moves to step 385 to move the receiver R2 and to step 386 to record in memory that a particular step of the pattern for the receiver R2 has been completed. The program then exits the subroutine and moves to step 363 shown in FIG. 4(*o*).

FIG. 4(*q*) is a flow chart illustrating the operation of a subroutine for executing the move ball carrier step 303 shown in FIG. 4(*l*). The subroutine is entered at step 400 and moves directly to step 401 at which a decision is made as to whether the key depressed in reaching step 303 is the pass key 38. If the pass key 38 has been depressed, the program moves to step 402 to switch the mode of the game from run to pass or from pass to run (depending on its previous state) and returns to step 305 shown in FIG. 4(*l*). If other than the pass key has been depressed, the program moves to step 404 to determine whether the kick key 36 has been depressed. If the kick key has been depressed, the program moves to step 405 to determine whether a kick may be made at the present time (the quarterback Q has not moved sideways from its initial position or crossed the scrimmage line). If a kick may not be made, the program exits the subroutine and returns to step 303 shown in FIG. 4(*l*).

Presuming that the kick key 36 has been depressed at step 404 and that a kick may be made at step 405, the program moves to step 407 to determine whether the game is in the pass mode. If the game is in the pass mode, a kick is a field goal; and the program moves to step 408 to execute such a field goal. If at step 407 the game is not in the pass mode, the kick is a punt; and the program moves to step 409 to execute a punt. From either step 408 or step 409, the program returns to step 305 of the subroutine shown in FIG. 4(*l*).

If at step 404 in FIG. 4(*q*), determination is made that the kick key 36 has not been depressed, the program moves to step 411 in which a determination is made as to whether one of the direction keys 39–42 has been depressed. If a direction key has not been depressed, the program returns to step 305 shown in FIG. 4(*l*). If a direction key has been depressed at step 411, the program moves to step 412 to inquire as to whether the game is in the pass mode. If the game is in the pass mode at step 412, the program moves to step 413 to execute a pass and then moves to step 305 shown in FIG. 4(*l*).

If at step 412, the game is not in the pass mode, the program moves to step 415 in which it is determined whether the ball carrier can move in the direction indicated by the particular direction key 39–42 which is depressed. If the ball carrier cannot so move, the program returns to the subroutine shown in FIG. 4(*l*). If the ball carrier can move at step 415 in the direction selected, the program moves to step 416 to effect the move of the ball carrier and then to step 417 to determine whether the direction selected is toward the sidelines. If the direction is toward the sidelines, the program moves to step 419 to store in memory the information that the ball may no longer be kicked.

From step 419 and from step 417 if the ball carrier is not moving sideways, the program moves to step 420 to determine whether the ball carrier has moved past the scrimmage line. If the ball carrier has moved past the scrimmage line, the program moves to step 422 to store this information so that the ball carrier may no longer kick or make a forward or sideways pass. From step 422 and from step 420 if the ball carrier has not moved past the scrimmage line, the program returns to step 305 shown in FIG. 4(*l*).

FIG. 4(*r*) is a flow chart illustrating the operation of a subroutine for the punt step 409 shown in FIG. 4(*q*). The subroutine is entered at step 430 and moves immediately to step 431 at which the ball is moved one space in the direction of the goal at which the offensive team may score. The program then moves to step 432 to determine whether the move has placed the ball in the end zone. If the move has placed the ball in the end zone at step 432, the program moves to step 433 to set the yard line for the next play as the twenty yard line and to step 434 to indicate that the play is over. The program then returns to the subroutine shown in FIG. 4(*q*).

If at step 432 the move has not placed the ball in the end zone, the program moves to step 436 to determine whether the ball has traveled ten yards. If the ball has not yet traveled ten yards at step 436, the program returns to step 431 to move the ball another space and repeats the subroutine. If at step 436 the ball has traveled ten yards, the program moves to step 437 to select a random number between one and thirty-two. The program then moves to step 438 to determine if the random number selected is one. If the number is not one (that is, in thirty-one out of thirty-two cases), the program returns to step 431 to move the ball another space. If at step 438 the random number selected is one, the program moves to step 439 to execute a return run of the ball and then exits the subroutine, returning to the subroutine shown in FIG. 4(*q*).

FIG. 4(*s*) illustrates a flow chart for a subroutine for executing the field goal step 408 shown in FIG. 4(*q*). The subroutine is entered at step 444 and moves directly to step 445 at which the ball is moved one space in the direction of the goal at which the offensive team may score. The program then moves to step 446 at which a determination is made as to whether the ball is in the end zone. If the ball is in the end zone, the program moves to step 448 to indicate that a field goal has been scored and returns to the subroutine shown in FIG. 4(*q*).

If at step 446 the ball is not in the end zone after the move accomplished in step 445, the program moves to step 449 to select a random number between one and thirty-two and to step 450 to determine if the number selected is one. If the number selected is not one (in thirty-one out of thirty-two cases), the program returns to step 445 to move the ball another space. If the number selected at step 449 is one, the program moves from step 450 to step 451 to indicate that the field goal was unsuccessful and then exits the subroutine and returns to the subroutine illustrated in FIG. 4(*q*).

FIG. 4($t_1$) illustrates a flow chart of a subroutine for executing the pass step 413 illustrated in FIG. 4(*q*). The subroutine is entered at step 460 and moves directly to step 461 at which a determination is made as to whether a forward or side pass may be made. This depends on whether the ball carrier is past the line of scrimmage or not. If the ball carrier has passed the line of scrimmage, then the program moves to step 462 to determine whether the direction key depressed causes the pass to move backwards for the offensive team (a pass which is always permitted). If the pass is not backwards, the program returns to the subroutine shown in FIG. 4(*q*).

If the pass is in the backward direction, the program moves to step 463.

The program also moves to step 463 from step 461 if the ball carrier has not passed the line of scrimmage. At step 463, the ball is moved in the selected direction in accordance with the direction key 39–42 which has been depressed. From step 463, the program moves to step 465 to determine whether an offensive man is at the ball's present position. If an offensive man is not at the ball's present position, the program moves to step 466 to determine whether a defensive man is at the ball's present position. If a defensive man is not at the ball's present position, the program moves to step 467 to determine whether the ball is at the forward wall of the display 14. If the ball is at the forward wall of the display 14, the program moves to step 468 to indicate an incompleted pass and then returns to the subroutine shown in FIG. 4(*q*). If the ball is not at the forward wall at step 467, the program moves to step 469 to determine whether the ball is at the back wall of the display 14. If the ball is at the back wall, the program moves to step 323 to execute a fumble in accordance with the subroutine of FIG. 4(*n*). If the ball is not at the back wall, the program returns to step 463 to move the ball another space in the direction indicated by the direction keys 39–42.

If at step 465 an offensive man is at the ball's present position after the ball's move of one space at step 463, the program moves to step 472 to determine whether the offensive man is one of the offensive linemen or the ball carrier, none of which may catch a pass. If the offensive man at the ball's position is an offensive lineman or the ball carrier, then the program moves to step 466 to determine whether there is a defensive man at the ball's present position. If at step 472 it is determined that the offensive man at the ball's position is not an offensive lineman or the ball carrier, it must be a receiver R1 or R2; and the program moves to step 473 to determine whether the ball is behind the scrimmage line and must, thus, be caught in the preferred embodiment. If the ball is behind the scrimmage line, the program moves to step 474 at which the pass is indicated as completed and the receiver R1 or R2 is made the ball carrier. The program then moves to step 475 to remove the old ball carrier from the screen, to step 476 to change the game to the run mode, and returns to the subroutine shown in FIG. 4(*q*).

If at step 473 it has already been determined that the ball is coincident with one of the receivers R1 or R2 and the ball is not behind the line of scrimmage, the program moves to step 477 at which a random number between one and eight is selected and to step 478 at which it is determined whether the number selected is one. If the number selected is one (in one out of eight cases), the program does not complete the pass to the receiver at the ball's position (creates a missed pass) and instead moves to step 466 to determine whether there is a defensive man at the ball's position. If at step 476 the random number selected is not one (in seven out of eight cases), the program moves to step 479 to determine whether the random number selected was two. If the number selected was two (in one out of eight cases), the program moves to step 468 to indicate an incompleted pass, then to step 476 to change the game to the run mode, and then returns to the subroutine shown in FIG. 4(*q*). If at step 477 it is determined that the number was not two (in six out of eight cases), the program moves to step 474 to indicate that the pass has been completed to the receiver R1 or R2 who now becomes the ball carrier. The program then moves to step 475 to cause the old ball carrier to disappear from the screen and to step 476 to change the game to the run mode. The program then returns to the subroutine of the flow chart shown in FIG. 4(*q*).

Thus when a receiver is at the position of the ball, in six out of eight cases he receives the ball, in one out of eight cases he drops the ball, and in the other one out of eight cases he misses the ball which will then be considered to have continued on.

In the case in which the ball continues on, the program moves to step 466 to determine whether a defensive man is at the ball's present position. If a defensive man is not at the ball's present position, then the program moves to step 467 and continues as explained above. If a defensive man is at the ball's position at step 466, the program moves to step 480 at which a random number between one and eight is selected. From step 480, the program moves to step 482 to determine whether the number one has been selected, and, if so, moves to step 467 to indicate that the ball has passed through the defensive man. If at step 482 the random number selected is not one (in seven out of eight cases), the program moves to step 483 to determine if the random number selected is two. If the random number selected is two (in one out of eight cases), the program moves to step 468 to indicate that the pass is incomplete to the defensive man at the ball's position, to step 476, and then returns to the subroutine shown in FIG. 4(*q*). If at step 483 the random number selected is not two (in six out of eight cases), the program moves to step 484 to indicate that an interception has been made, to establish the defensive man which intercepted the ball as the new ball carrier, and to switch the roles of the offense and defense. The program then moves to step 485 to change the game to the run mode and returns to the subroutine shown in FIG. 4(*q*).

FIG. 4($t_2$) is a flow chart illustrating a second embodiment of the invention in which the offensive player catches a pass by depressing the pass key when a receiver is at the ball's position. This embodiment contrasts with the previously discussed embodiment in which a pass is received, dropped, or missed on a random selection basis at a position at which the receiver and the ball coincide.

The subroutine is entered at step 510 at which the program awaits the depression of an input key. The program moves to step 510 from step 463 shown in FIG. 4($t_1$) in which the ball is moved in the direction selected by the player operating the offense. The program moves from step 510 upon the depression of an input key to step 512 at which a determination is made as to whether the key depressed is the pass key 38. If the pass key 38 has been depressed, the program moves to step 514 to determine whether the key 38 depressed is controlled by the offensive or defensive console. If the pass key 38 has not been depressed, the program moves directly to a step 518.

If at step 514 the pass key 38 controlled by the offense has been depressed, the program moves to step 516 to determine whether the pass key 38 was depressed a previous time but since the pass was initiated. If this is the first time the pass key 38 has been depressed since the pass was initiated, the program moves to step 517 to set the position of the ball B at the time the pass key 38 is depressed as the comparison position to determine whether the pass is received. If, on the other hand, the pass button has been depressed prior to this depression, the program moves directly to step 518 bypassing step 517. The program also moves to step 518 from step 517. The effect of this is to allow the pass key 38 signaling a catch to be depressed at only one position in the ball's flight by the offense.

In like manner, if at step 514 the defensive pass key 38 has been depressed, the program moves to step 519 to determine whether the defensive pass key 38 has been depressed previously since the pass was initiated. If the defensive pass key 38 has been depressed previously, the program moves directly to step 518. If the defensive pass key 38 has not been depressed previously, the program moves to step 520 to set the position of the ball B at the depression of the pass key 38 as the position of the ball B is to be compared with the defensive man's position in order to determine whether an interception has occurred. Thus, the defense receives only one chance to intercept the ball B per pass. From steps 519 and 520, the program moves to step 518.

At step 518 a determination is made as to whether an offensive man at the ball's position. If there is an offensive man at the ball's position, the program moves to step 522 to determine whether the offensive man is the quarterback or one of the offensive linemen who are ineligible receivers. If the offensive man is not the quarterback or an offensive lineman, the program moves to step 523 to determine whether the ball is behind the line of scrimmage. If the ball is behind the line of scrimmage, the program moves to step 524 at which the pass is completed, and the receiver becomes the new ball carrier with the old ball carrier disappearing from the screen. This occurs because all passes behind the line of scrimmage are completed.

If the ball is not behind the line of scrimmage, the program moves to step 525 at which a determination is made as to whether the pass key 38 has been depressed at all.

If at step 525, the pass button 38 operated by the offensive player has been depressed, the program moves to step 540 to determine whether the positions of the ball B and the offensive receiver coincided at the time the key 38 was depressed. If they did not coincide, the program moves to step 530 to indicate an incompleted pass and to step 531 to complement the game mode to run. If the positions of the ball B and the receiver coincided, the program moves to step 524 to indicate the pass was completed and then proceeds to step 531. From step 531, the program returns to the subroutine shown in FIG. 4(*q*).

If at step 525 the key 38 has not been depressed, the program moves to step 526 to determine whether a defensive man is at the ball's position. The program also moves to step 526 from step 518 if there is no offensive man at the ball's position and from step 522 if the offensive man at the ball's position is an ineligible receiver. At step 526 a determination is made as to whether there is a defensive man at the ball's position. If there is no defensive man at the ball's position, the program moves to step 528 to determine whether the ball is at the front wall and, if not, to step 529 to determine that the ball is at the back wall. If the ball is at the front wall at step 528, the program proceeds to step 530 to indicate a completed pass and to step 531 to complement the game mode to run in memory and then returns to the routine shown in FIG. 4(*g*). If at step 529 the ball is at the back wall, the program moves to step 532 to indicate a fumble. If the ball is not at the back wall at step 529, the program recycles to step 463 shown in FIG. 4($t_1$).

If at step 526 there is a defensive man at the ball B's position, the program moves to step 535 to determine whether the pass key 38 of the defense has been depressed. If the key 38 has not been depressed, the program moves to step 528 and proceeds as explained above. If the pass key 38 has been depressed, the program moves to step 537 to determine whether the position of the ball coincided with the position of the defensive man when the pass key 38 was depressed. If not, the program proceeds to step 530 to indicate an incompleted pass and proceeds as explained above. If the positions coincided, the program moves to step 538 to indicate an interception, to change the defensive man to the new ball carrier, and to switch the roles of the offense and defense. The program then moves to step 539 to complement the game mode and returns to the routine shown in FIG. 4(*q*).

FIG. 4(*u*) illustrates a flow chart of a subroutine for step 306 shown in FIG. 4(*l*) by which a decision is made as to whether play is over during any particular play action mode. The subroutine is entered at step 490 and moves immediately to step 491 at which a determination is made as to whether the ball carrier has been tackled. If the ball carrier has been tackled, the play is over and the program returns to the routine shown in FIG. 4(*a*). If the ball carrier has not been tackled, the program moves to step 492 at which it is determined whether the ball has been fumbled. If the ball has been fumbled, the play is over and the program returns to the routine shown in FIG. 4(*a*).

If the ball has not been fumbled, the program moves to step 493 to determine whether the ball has been kicked. If the ball has been kicked and the play has run, then play is over and the ball returns to the routine shown in FIG. 4(*a*). If the ball has not been kicked, then the program moves to step 494 to determine whether the ball carrier has run out of bounds. If the ball carrier has run out of bounds, the play is over and the program returns to the flow chart shown in FIG. 4(*a*). If the ball carrier has not run out of bounds, the program moves to step 495 to determine whether a score has occurred on the play. If a score has occurred, the play is over and the program returns to the flow chart shown in FIG. 4(*a*). If a score has not occurred, play continues and returns to step 63 shown in FIG. 4(*a*).

FIG. 4(*v*) illustrates a flow chart of a subroutine utilized once the game is over for allowing status to be checked. The subroutine begins at step 496 and moves immediately to step 497 at which it awaits the depression of an input key. Upon the depression of an input key, the program moves to step 498 to inquire as to whether it is one of the four status keys 20–23. If it is not a status key, the program recycles to step 478. If a status key 20–23 is depressed, the program moves to step 499 to display the status of the game in accordance with the particular key depressed and then recycles to step 497.

As will be understood by those skilled in the art, many different programs may be utilized to implement the flow chart disclosed in FIGS. 4(*a*) through 4(*v*). Obviously, these programs will vary from one another in various degrees. However, it is well within the skill of the art of the computer programmer to provide particular programs for implementing each of the steps of the flow charts disclosed herein. It is also to be understood that various microcomputer circuits might be programmed for implementing each of the steps of the flow chart disclosed herein other than those selected for the preferred embodiment without departing from the teaching of the invention. It is therefore to be understood that, because various other embodiments may be devised by those skilled in the art without departing from the spirit and scope of the invention, it is the intention of the inventors to be limited only by the scope of the claims appended hereto.

What is claimed is:

1. An electronic football game comprising:

a display in the form of a playing field having indicia representing a ball, a plurality of offensive players including a quarterback and at least two receivers any one of which may be a ball carrier and each capable of receiving the ball, running with the ball and passing the ball at any time during an individual play of the game, and a plurality of defensive players;

run input means responsive to operator control for maneuvering the ball carrier about the field at any time during an individual play of the game;

pass input means responsive to operator control for passing the ball from the ball carrier at any time during an individual play of the game and from any position on the playing field; and control means responsive to the run and pass input means for starting an individual play, for executing multiple run maneuvers and multiple pass maneuvers during an individual play of the game in response to the run input means and the pass input means, respectively, and for controlling the display indicia to indicate the positions and movement of the players and the ball, and including line means for determining a line of scrimmage on the field, means for determining the position of the ball carrier on the field, means for enabling the ball carrier to execute a forward pass, means for enabling the ball carrier to execute a lateral or backward transfer of the ball, and means for preventing the ball carrier from executing a forward pass if the ball carrier has crossed the line of scrimmage.

2. The game of claim 1 further including program input means responsive to operator control for programming prior to the start of an individual play the movements of the receivers during the subsequent play, and in which the control means is further responsive to the program input means for storing the programmed movements, and includes means for causing the receivers to move in accordance with the stored programs when the play is started, and means for switching the movement control of any one of the receivers from its stored program to the run input means if that one receiver has possession of the ball.

3. The game of claim 1 in which the control means further includes encounter detection means for detecting whether a pass by the ball carrier having possession of the ball is encountered by any receiver, said encounter occurring when the position of the ball corresponds with the position of that receiver; outcome means for providing a plurality of predetermined outcomes of a pass maneuver; probability means for providing a probability of occurrence for each of the plurality of outcomes of a pass maneuver; and play determining means responsive to the encounter detection means, the outcome means, and the probability means for determining the outcome of an encountered pass as being one of the predetermined outcomes, where the outcome determination is a function of the probability of occurrence for each outcome; and in which the control means causes the display indicia to indicate the determined outcome.

4. An electronic football game comprising:

a display in the form of a playing field having indicia representing a ball, a plurality of offensive players including a quarterback and at least two receivers any one of which may be a ball carrier and each capable of receiving the ball, running with the ball and passing the ball at any time during an individual play of the game, and a plurality of defensive players;

run input means responsive to operator control for maneuvering the ball carrier about the field at any time during an individual play of the game;

pass input means responsive to operator control for passing the ball from the ball carrier at any time during an individual play of the game and from any position on the playing field; and control means responsive to the run and pass input means for starting an individual play, for executing multiple run maneuvers and multiple pass maneuvers during an individual play of the game in response to the run input means and the pass input means, respectively, and for controlling the display indicia to indicate the positions and movement of the players and the ball, and including line means for determining a line of scrimmage on the field, and means responsive to the line means for suppressing the display indicium of the ball if the ball has not crossed the line of scrimmage.

5. An electronic football game comprising:

a display in the form of a playing field having indicia representing a ball, a plurality of offensive players including a quarterback and at least two receivers any one of which may be a ball carrier and each capable of receiving the ball, running with the ball and passing the ball at any time during an individual play of the game, and a plurality of defensive players;

run input means responsive to operator control for maneuvering the ball carrier about the field at any time during an individual play of the game;

pass input means responsive to operator control for passing the ball from the ball carrier at any time during an individual play of the game and from any position on the playing field and including operator actuated catch means for enabling any receiver to catch a pass; and control means responsive to the run and pass input means for starting an individual play, for executing multiple run maneuvers and multiple pass maneuvers during an individual play of the game in response to the run input means and the pass input means, respectively, and for controlling the display indicia to indicate the positions and movement of the players and the ball, and including encounter detection means for detecting whether a pass by the ball carrier is encountered by any receiver, said encounter occurring when the position of the ball corresponds with the position of that receiver; outcome means for providing a plurality of predetermined outcomes of a pass maneuver; and play determining means responsive to the catch means, the encounter detection means, and the outcome means for determining the outcome of an encountered pass as being one of the predetermined outcomes, where the outcome determination is a function of the actuation of the catch means and the detection of an encounter, and in which the control means causes the display indicia to indicate the determined outcome.

6. An electronic football game comprising:

a display in the form of a playing field having indicia representing a ball, a plurality of offensive players including one offensive player designated a quarterback and at least one other offensive player designated a receiver, and a plurality of defensive players;

run input means responsive to operator control for maneuvering about the field the offensive player having possession of the ball;

pass input means responsive to operator control for passing the ball from the quarterback and including catch means for enabling the receiver to catch the pass; and control means responsive to the run and pass input means for controlling the display indicia to indicate the positions and the movements of the players and the ball and including encounter detection means for detecting whether a pass is encountered by the receiver, said encounter occurring when the position of the ball corresponds with the position of the receiver; outcome means for providing a plurality of predetermined outcomes of a pass maneuver; and play determining means responsive to the catch means, the encounter detection means and the outcome means for determining the outcome of a pass maneuver as being one of the predetermined outcomes where the outcome determination is a function of the actuation of the catch means and the detection of an encounter, and in which the control means causes the display indicia to indicate the determined outcome.

7. The game of claim 5 or 6 in which the play determining means includes event storage means for storing a catch event when the catch means is actuated and for storing an encounter event when the ball is encountered, and timing means for determining the time difference between the events, and in which the outcome determination of a pass maneuver is a function of the time difference between the catch event and the encounter event.

8. The game of claim 7 in which the plurality of predetermined outcomes include a caught ball, a dropped ball, and a missed ball; and in which the play determining means determines the outcome of a pass maneuver as a dropped ball if the catch event precedes in time the encounter event, as a caught ball if the catch event coincides in time with the encounter event, and as a missed ball if the catch event is subsequent in time to the encounter event.

9. The game of claims 3, 5 or 6 in which the plurality of predetermined outcomes include a caught ball, a dropped ball, and a missed ball.

10. An electronic football game comprising:

a display in the form of a playing field having indicia representing a ball, a plurality of offensive players at least one of which may possess the ball, and a plurality of defensive players;

run input means responsive to operator control for maneuvering about the field a first offensive player in possession of the ball; and control means responsive to the input means for sequentially moving a second offensive player and at least one of the defensive players about the field, and incuding encounter detection means for detecting an encounter when either the second offensive player or the one defensive player is an attacker attempting to occupy the same position on the field as the other, or attacked, player; means for preventing the attacker from occupying the same position as the attacked player; means for moving the attacker through the position of the attacked player without disturbing the attacked player; means for causing the attacker to displace the attacked player from its position; outcome means for providing a plurality of predetermined outcomes of a blocking maneuver; probability means for providing a probability of occurrence for each of the plurality of outcomes of a blocking maneuver where each probability is a function of whether the attacker is an offensive player or a defensive player; and play determining means responsive to the encounter detection means, the outcome means and the probability means for determining the outcome of the encounter as being one of the predetermined outcomes, where the outcome determination is a function of the probability of occurrence for each outcome, and in which the control means causes the display indicia to indicate the determined outcome, and in which the plurality of predetermined outcomes include the attacker blocked from occupying the same position as the attacked player, the attacker moving through the position of the attacked player without disturbing the attacked player, and the attacker displacing the attacked player from its position.

11. An electronic football game comprising:

a display in the form of a playing field having indicia representing a ball, a plurality of offensive players at least one of which may possess the ball, and a plurality of defensive players at least one of which may possess the ball;

first input means responsive to operator control for maneuvering about the field a first offensive player in possession of the ball;

second input means responsive to operator control for maneuvering about the field a first defensive player which may capture the ball; and control means responsive to the first and second input means and including encounter detection means for detecting when the first offensive and defensive players encounter each other, said encounter occurring when the positions of the first offensive and defensive players correspond, outcome means for providing a plurality of predetermined outcomes of a tackle maneuver, including the first defensive player tackling the first offensive player with the first offensive player retaining possession of the ball, and the first offensive player fumbling the ball, probability means for providing a probability of occurrence for each of the plurality of outcomes of a tackle maneuver, play determining means responsive to the encounter detection means, the outcome means, and the probability means for determining the outcome of the encounter as being one of the predetermined outcomes, where the outcome determination is a function of the probability of occurrence for each outcome, fumble means responsive to the play determining means for determining the position on the field at which a fumbled ball comes to rest, and recovery means responsive to the fumble means for causing the first offensive player to recover possession of the fumbled ball if that player moves to the rest position of the fumbled ball before the first defensive player moves to that position, and for causing the first defensive player to recover the ball if that player moves to the rest position before the first offensive player moves to that position, and in which the control means causes the display indicia to indicate that the ball has been fumbled, to indicate the rest position of the fumbled ball, and to indicate the player who obtains possession of the fumbled ball.

12. The game of claim 11 in which the recovery means further includes position means for determining if the first offensive player is already at the rest position of the fumbled ball and for providing a position indication when such determination is made, and means responsive to the position means for causing the first offensive player to recover possession of the fumbled ball when the position indication is provided only if the first offensive player moves away from and back to the rest position of the fumbled ball before the first defensive player moves to that rest position.

* * * * *